US007328994B2

(12) United States Patent
Silverbrook

(10) Patent No.: US 7,328,994 B2
(45) Date of Patent: Feb. 12, 2008

(54) PRINT ENGINE ASSEMBLY WITH SLOTTED CHASSIS

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 11/520,575

(22) Filed: Sep. 14, 2006

(65) Prior Publication Data

US 2007/0013739 A1 Jan. 18, 2007

Related U.S. Application Data

(63) Continuation of application No. 11/228,434, filed on Sep. 19, 2005, now Pat. No. 7,114,868, which is a continuation of application No. 10/728,926, filed on Dec. 8, 2003, now Pat. No. 6,997,625, which is a continuation of application No. 10/172,024, filed on Jun. 17, 2002, now Pat. No. 6,796,731, which is a continuation of application No. 09/575,111, filed on May 23, 2000, now Pat. No. 6,488,422.

(51) Int. Cl.
*B41J 2/01* (2006.01)

(52) U.S. Cl. ..... 347/104; 347/8; 347/31; 347/32; 347/42; 347/43

(58) Field of Classification Search ..... None
See application file for complete search history.

(56) References Cited

U.S. PATENT DOCUMENTS 4,417,259 A 11/1983 Maeda
4,555,717 A 11/1985 Miura et al.
4,883,219 A 11/1989 Anderson et al.
4,959,662 A 9/1990 Kobayashi
5,017,947 A 5/1991 Masuda
5,040,908 A 8/1991 Matsuya et al.
5,051,761 A 9/1991 Fisher et al.
5,065,169 A 11/1991 Vincent et al.
5,081,472 A 1/1992 Fisher
5,108,205 A 4/1992 Stone
5,172,987 A 12/1992 Stellmach et al.
5,181,050 A * 1/1993 Bibl et al. ..... 347/148
5,276,468 A 1/1994 Deur et al.

(Continued)

FOREIGN PATENT DOCUMENTS

EP 313204 4/1989

(Continued)

OTHER PUBLICATIONS

Manual for Apple StyleWriter 1200 (http://download.info.apple.com/Apple_Support_Area/Manuals/printers/0306833AASW1200SU.PDF), pp. 5, 52, 61.*

*Primary Examiner*—Lamson Nguyen
*Assistant Examiner*—Justin Seo

(57) ABSTRACT

A print engine assembly includes an elongate chassis that defines a channel and a slot. A printhead assembly is fast with respect to the chassis and is configured to print upon print media fed through the chassis. A pair of bearing moldings is located within the channel and mounted on respective, opposite ends of the chassis. A print media feed mechanism is mounted between the bearing moldings and is arranged to feed the print media through the chassis in register with the printhead assembly and out through the slot.

7 Claims, 22 Drawing Sheets

U.S. PATENT DOCUMENTS

| | | | | |
|---|---|---|---|---|
| 5,309,176 | A | 5/1994 | Faes et al. | |
| 5,316,395 | A | 5/1994 | Imai | |
| 5,366,301 | A | 11/1994 | Martin et al. | |
| 5,381,162 | A | 1/1995 | Roy et al. | |
| 5,412,411 | A | 5/1995 | Anderson et al. | |
| 5,502,471 | A | 3/1996 | Obermeier et al. | |
| 5,570,959 | A | 11/1996 | Moriwaki et al. | |
| 5,594,481 | A | 1/1997 | Keefe et al. | |
| 5,610,636 | A | 3/1997 | Hanabusa et al. | |
| 5,753,959 | A | 5/1998 | Quinn et al. | |
| 5,757,398 | A | 5/1998 | Anderson et al. | |
| 5,806,992 | A * | 9/1998 | Ju | 400/56 |
| 5,876,582 | A | 3/1999 | Frazier | |
| 5,929,877 | A | 7/1999 | Hetzer et al. | |
| 5,963,234 | A | 10/1999 | Miyazawa et al. | |
| 6,047,816 | A | 4/2000 | Moghadam et al. | |
| 6,065,825 | A | 5/2000 | Anagnostopoulos et al. | |
| 6,102,509 | A | 8/2000 | Olsen | |
| 6,123,260 | A | 9/2000 | Menzenski | |
| 6,172,691 | B1 | 1/2001 | Belon et al. | |
| 6,250,738 | B1 | 6/2001 | Waller et al. | |
| 6,259,808 | B1 * | 7/2001 | Martinez et al. | 382/139 |
| 6,281,912 | B1 | 8/2001 | Silverbrook | |
| 6,318,920 | B1 | 11/2001 | Silverbrook | |
| 6,322,206 | B1 | 11/2001 | Boyd et al. | |
| 6,350,013 | B1 | 2/2002 | Scheffelin et al. | |
| 6,398,330 | B1 | 6/2002 | Chua et al. | |
| 6,409,323 | B1 | 6/2002 | Silverbrook | |
| 6,457,810 | B1 | 10/2002 | King et al. | |
| 6,485,135 | B1 * | 11/2002 | Foote et al. | 347/84 |
| 6,488,422 | B1 | 12/2002 | Silverbrook | |
| 6,561,608 | B1 | 5/2003 | Yamamoto et al. | |
| 6,585,347 | B1 | 7/2003 | Johnson et al. | |
| 6,786,658 | B2 | 9/2004 | Silverbrook | |
| 6,796,731 | B2 | 9/2004 | Silverbrook | |
| 6,966,625 | B2 | 11/2005 | Silverbrook | |
| 6,994,419 | B2 | 2/2006 | Silverbrook | |
| 7,021,742 | B2 * | 4/2006 | Silverbrook | 347/29 |
| 2004/0119775 | A1 * | 6/2004 | Silverbrook | 347/29 |
| 2006/0012635 | A1 * | 1/2006 | Silverbrook et al. | 347/49 |

FOREIGN PATENT DOCUMENTS

| | | | |
|---|---|---|---|
| EP | 336870 | | 10/1989 |
| EP | 0336870 | | 10/1989 |
| EP | 0566540 | | 10/1993 |
| EP | 566540 | | 10/1993 |
| EP | 584823 | A | 3/1994 |
| EP | 597621 | | 5/1994 |
| EP | 0598701 | A | 5/1994 |
| EP | 604029 | | 6/1994 |
| EP | 694401 | A | 1/1996 |
| EP | 921008 | A | 6/1999 |
| EP | 1078755 | | 2/2001 |
| GB | 2115748 | A | 9/1983 |
| GB | 2267255 | A | 12/1993 |
| GB | 2297521 | | 8/1996 |
| GB | 2358947 | | 8/2001 |
| JP | 57-163588 | A | 10/1982 |
| JP | 59115863 | | 7/1984 |
| JP | 03-234539 | | 10/1991 |
| JP | 08324065 | | 12/1996 |
| JP | 09141858 | | 6/1997 |
| JP | 09286148 | A | 11/1997 |
| JP | 10138461 | | 5/1998 |
| JP | 10153453 | | 6/1998 |
| JP | 10193626 | A | 7/1998 |
| JP | 10264390 | | 10/1998 |
| JP | 10324003 | A | 12/1998 |
| JP | 11179900 | | 7/1999 |
| JP | 11-348373 | | 12/1999 |
| WO | WO 01/42027 | A | 6/2001 |

* cited by examiner

PRINT ENGINE ASSEMBLY WITH SLOTTED CHASSIS

CROSS REFERENCE TO RELATED APPLICATION

The present application is a continuation of U.S. application Ser. No. 11/228,434 filed on Sep. 19, 2005, now U.S. Pat. No. 7,114,868 which is a continuation of U.S. application Ser. No. 10/728,926 filed on Dec. 8, 2003, now issued as U.S. Pat. No. 6,997,625, which is a continuation of U.S. application Ser. No. 10/172,024 filed on Jun. 17, 2002, now issued as U.S. Pat. No. 6,796,731, which is a continuation of U.S. application Ser. No. 09/575,111 filed on May 23, 2000, now issued as U.S. Pat. No. 6,488,422, the entire contents of which are herein incorporated by reference.

CO-PENDING APPLICATIONS

Various methods, systems and apparatus relating to the present invention are disclosed in the following co-pending applications filed by the applicant or assignee of the present invention simultaneously with the present application:

| | | | | | |
|---|---|---|---|---|---|
| 6428133 | 6526658 | 6315399 | 6338548 | 6540319 | 6328431 |
| 6328425 | 6991320 | 6383833 | 6464332 | 6390591 | 7018016 |
| 6328417 | 6322194 | 6382779 | 6629745 | 09/575197 | 7079712 |
| 6825945 | 09/575165 | 6813039 | 6987506 | 7038797 | 6980318 |
| 6816274 | 7102772 | 09/575186 | 6681045 | 6728000 | 7173722 |
| 7088459 | 09/575181 | 7068382 | 7062651 | 6789194 | 6789191 |
| 6644642 | 6502614 | 6622999 | 6669385 | 6549935 | 6987573 |
| 6727996 | 6591884 | 6439706 | 6760119 | 09/575198 | 6290349 |
| 6428155 | 6785016 | 6870966 | 6822639 | 6737591 | 7055739 |
| 7233320 | 6830196 | 6832717 | 6957768 | 09/575172 | 7170499 |
| 7106888 | 7123239 | 6409323 | 6281912 | 6604810 | 6318920 |
| 6488422 | 6795215 | 7154638 | 6859289 | 6924907 | 6712452 |
| 6416160 | 6238043 | 6958826 | 6812972 | 6553459 | 6967741 |
| 6956669 | 6903766 | 6804026 | 7259889 | 6975429 | |

The disclosures of these co-pending applications are incorporated herein by reference.

BACKGROUND OF THE INVENTION

The following invention relates to a laminated ink distribution structure for a printer.

More particularly, though not exclusively, the invention relates to a laminated ink distribution structure and assembly for an A4 pagewidth drop on demand printhead capable of printing up to 1600 dpi photographic quality at up to 160 pages per minute.

The overall design of a printer in which the structure/assembly can be utilized revolves around the use of replaceable printhead modules in an array approximately 8 inches (20 cm) long. An advantage of such a system is the ability to easily remove and replace any defective modules in a printhead array. This would eliminate having to scrap an entire printhead if only one chip is defective.

A printhead module in such a printer can be comprised of a "Memjet" chip, being a chip having mounted thereon a vast number of thermo-actuators in micro-mechanics and micro-electromechanical systems (MEMS). Such actuators might be those as disclosed in U.S. Pat. No. 6,044,646 to the present applicant, however, there might be other MEMS print chips.

The printhead, being the environment within which the laminated ink distribution housing of the present invention is to be situated, might typically have six ink chambers and be capable of printing four color process (CMYK) as well as infra-red ink and fixative. An air pump would supply filtered air to the printhead, which could be used to keep foreign particles away from its ink nozzles. The printhead module is typically to be connected to a replaceable cassette which contains the ink supply and an air filter.

Each printhead module receives ink via a distribution molding that transfers the ink. Typically, ten modules butt together to form a complete eight inch printhead assembly suitable for printing A4 paper without the need for scanning movement of the printhead across the paper width.

The printheads themselves are modular, so complete eight inch printhead arrays can be configured to form printheads of arbitrary width.

Additionally, a second printhead assembly can be mounted on the opposite side of a paper feed path to enable double-sided high speed printing.

OBJECTS OF THE INVENTION

It is an object of the present invention to provide an ink distribution assembly for a printer.

It is another object of the present invention to provide an ink distribution structure suitable for the pagewidth printhead assembly as broadly described herein.

It is another object of the present invention to provide a laminated ink distribution assembly for a printhead assembly on which there is mounted a plurality of print chips, each comprising a plurality of MEMS printing devices.

It is yet another object of the present invention to provide a method of distributing ink to print chips in a printhead assembly of a printer.

SUMMARY OF THE INVENTION

The present invention provides an ink distribution assembly for a printhead to which there is mounted an array of print chips, the assembly serving to distribute different inks from respective ink sources to each said print chip for printing on a sheet, the assembly comprising:

a longitudinal distribution housing having a duct for each said different ink extending longitudinally therealong, a cover having an ink inlet port corresponding to each said duct for connection to each said ink source and for delivering said ink from each said ink source to a respective one of said ink ducts, and a laminated ink distribution structure fixed to said distribution housing and distributing ink from said ducts to said print chips.

Preferably the laminated ink distribution structure includes multiple layers situated one upon another with at least one of said layers having a plurality of ink holes therethrough, each ink hole conveying ink from one of said ducts enroute to one of said print chips.

Preferably one or more of said layers includes ink slots therethrough, the slots conveying ink from one or more of said ink holes in an adjacent layer enroute to one of said print chips.

Preferably, the slots are located with ink holes spaced laterally to either side thereof.

Preferably the layers of the laminated structure sequenced from the distribution housing to the array of print chips include fewer and fewer said ink holes.

Preferably one or more of said layers includes recesses in the underside thereof communicating with said holes and transferring ink therefrom transversely between the layers enroute to one of said slots.

Preferably the channels extend from the holes toward an inner portion of the laminated structure over the array of print chips, which inner portion includes said slots.

Preferably each layer of the laminated is a micro-molded plastics layer.

Preferably, the layers are adhered to one another.

Preferably, the slots are parallel with one another.

Preferably, at least two adjacent ones of said layers have an array of aligned air holes therethrough.

The present invention also provides a laminated ink distribution structure for a printhead, the structure comprising:

a number of layers adhered to one another, each layer including a plurality of ink holes formed therethrough, each ink hole having communicating therewith a recess formed in one side of the layer and allowing passage of ink to a transversely located position upon the layer, which transversely located position aligns with a slot formed through an adjacent layer.

Preferably the slot in any layer of the structure is aligned with another slot in an adjacent layer of the structure and the aligned slots are aligned with a respective print chip slot formed in a final layer of the structure.

Preferably the layers are micro-molded plastics layers.

The present invention also provides a method of distributing ink to an array of print chips in a printhead assembly, the method serving to distribute different inks from respective ink sources to each said print chip for printing on a sheet, the method comprising:

supplying individual sources of ink to a longitudinal distribution molding having a duct for each said different ink extending longitudinally therealong, causing ink to pass along the individual ducts for distribution thereby into a laminated ink distribution structure fixed to the distribution housing, wherein the laminated ink distribution structure enables the passage therethrough of the individual ink supplies to the print chips, which print chips selectively eject the ink onto a sheet.

The present invention also provides a method of distributing ink to print chips in a printhead assembly of a printer, the method utilizing a laminated ink distributing structure formed as a number of micro-molded layers adhered to one another with each layer including a plurality of ink holes formed therethrough, each ink hole communicating with a channel formed in one side of a said layer and allowing passage of ink to a transversely located position within the structure, which transversely located position aligns with an aperture formed through an adjacent layer of the laminated structure, an adjacent layer or layers of the laminated structure also including slots through which ink passes to the print chips.

As used herein, the term "ink" is intended to mean any fluid which flows through the printhead to be delivered to a sheet. The fluid may be one of many different coloured inks, infra-red ink, a fixative or the like.

BRIEF DESCRIPTION OF THE DRAWINGS

A preferred form of the present invention will now be described by way of example with reference to the accompanying drawings wherein.

DETAILED DESCRIPTION OF THE INVENTION

Figure 1:
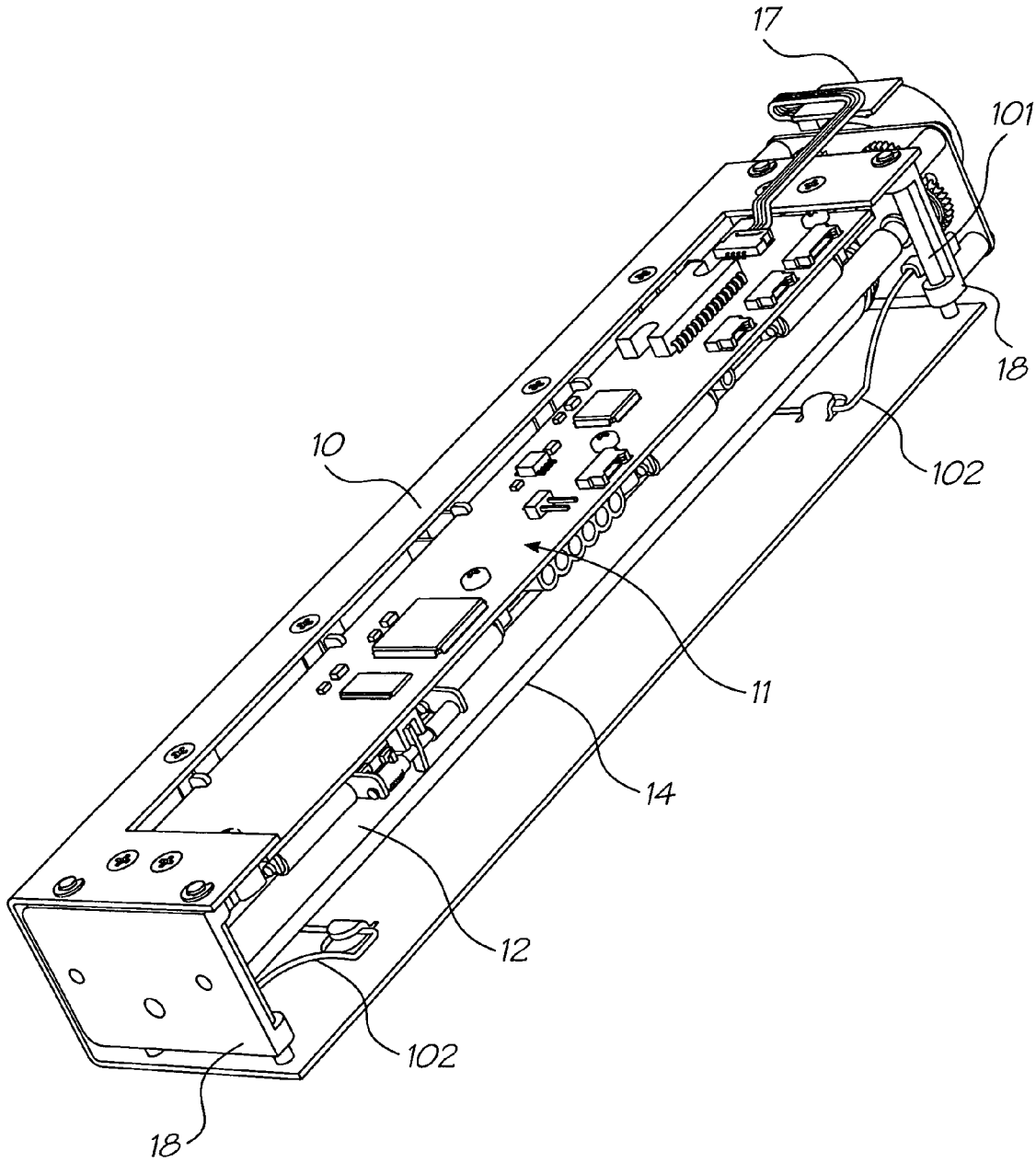
FIG. 1 is a front perspective view of a print engine assembly
Figure 2:
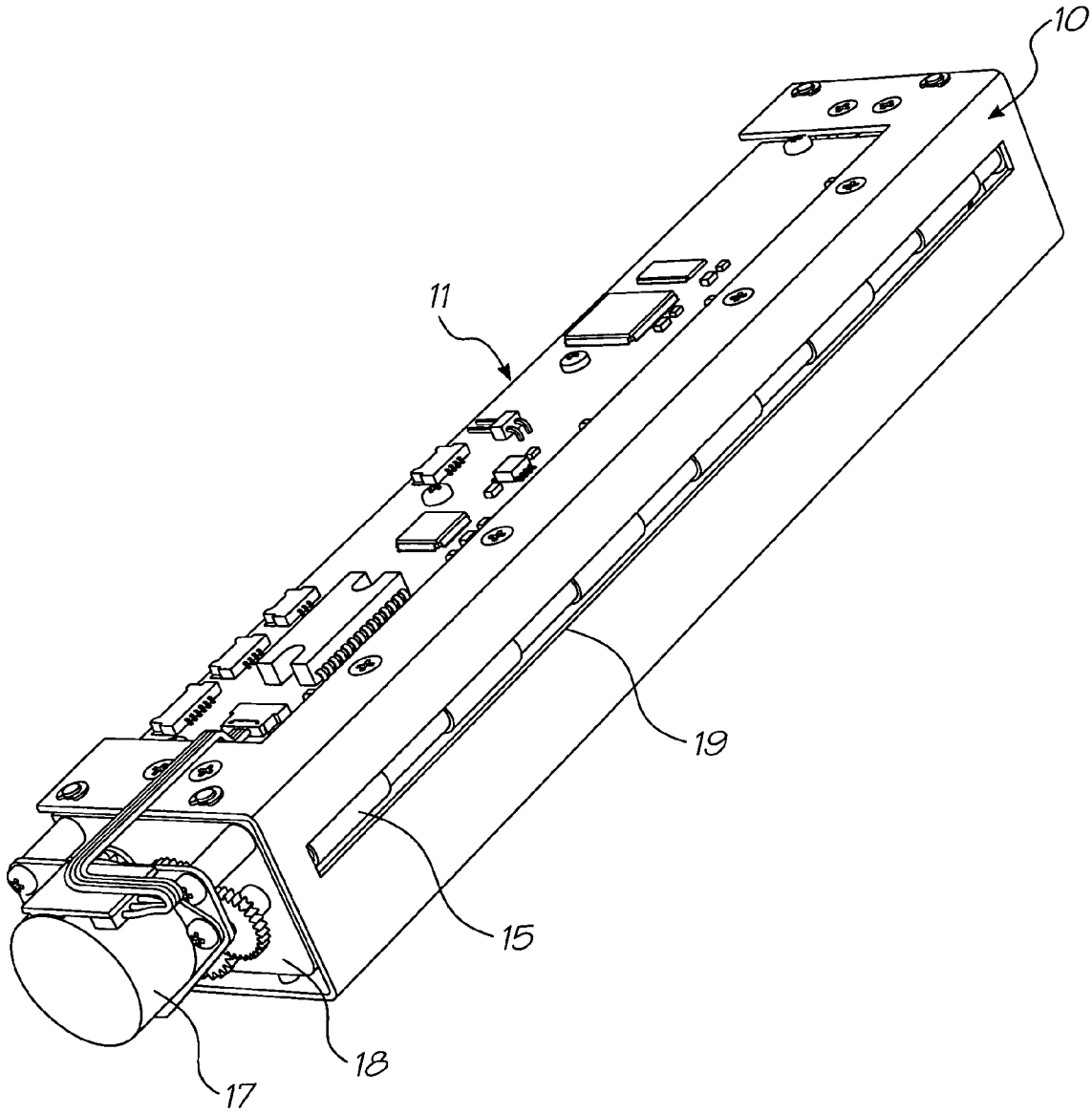
FIG. 2 is a rear perspective view of the print engine assembly of FIG. 1
Figure 3:
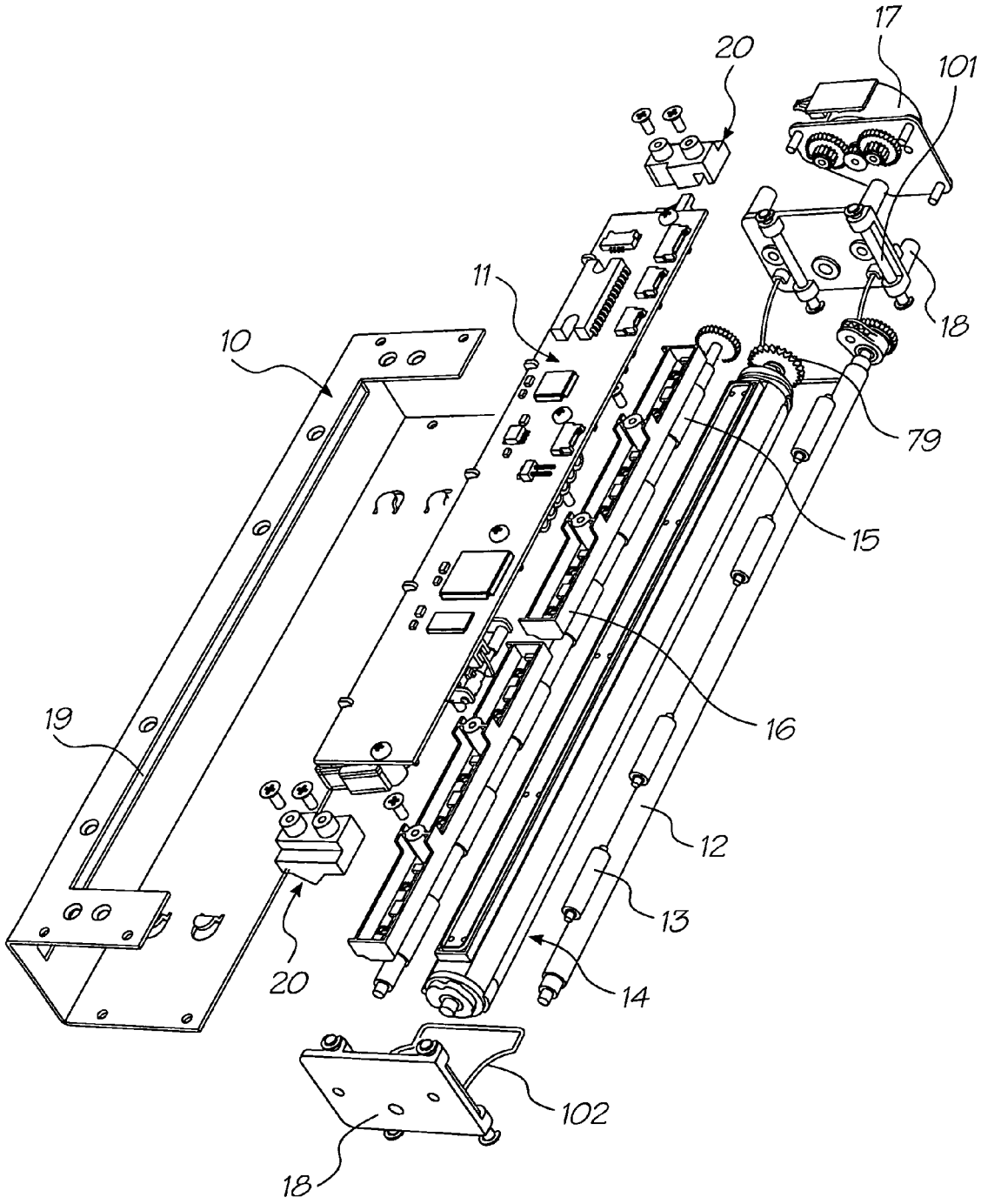
FIG. 3 is an exploded perspective view of the print engine assembly of FIG. 1.
Figure 4:
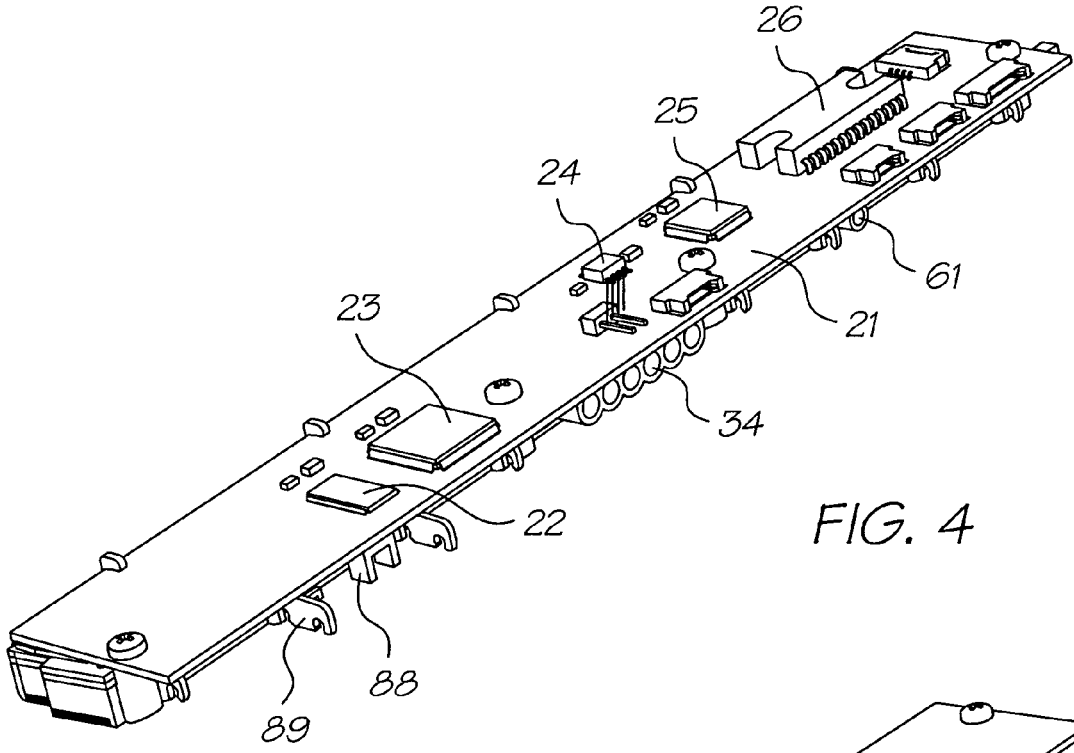
FIG. 4 is a schematic front perspective view of a printhead assembly.
Figure 5:
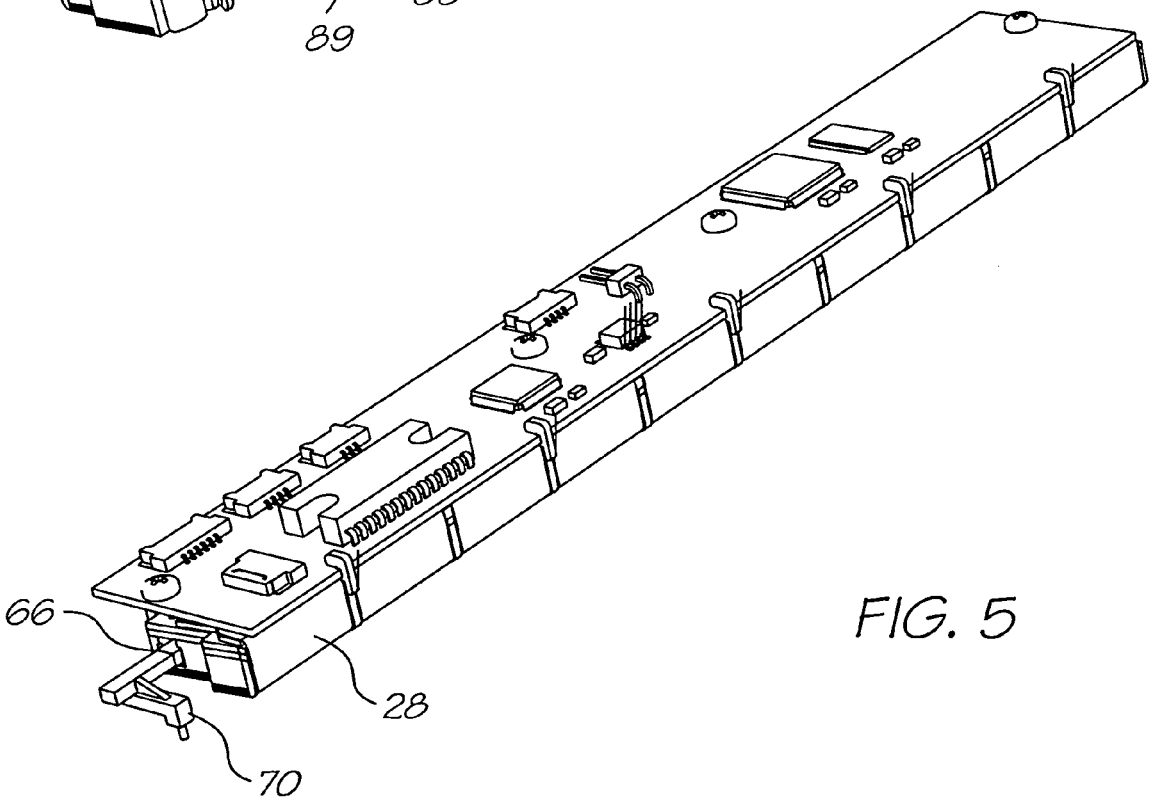
FIG. 5 is a rear schematic perspective view of the printhead assembly of FIG. 4.

In FIGS. 1 to 3 of the accompanying drawings there is schematically depicted the core components of a print engine assembly, showing the general environment in which the laminated ink distribution structure of the present invention can be located. The print engine assembly includes a chassis 10 fabricated from pressed steel, aluminium, plastics or other rigid material. Chassis 10 is intended to be mounted within the body of a printer and serves to mount a printhead assembly 11, a paper feed mechanism and other related components within the external plastics casing of a printer.

In general terms, the chassis 10 supports the printhead assembly 11 such that ink is ejected therefrom and onto a sheet of paper or other print medium being transported below the printhead then through exit slot 19 by the feed mechanism. The paper feed mechanism includes a feed roller 12, feed idler rollers 13, a platen generally designated as 14, exit rollers 15 and a pin wheel assembly 16, all driven by a stepper motor 17. These paper feed components are mounted between a pair of bearing moldings 18, which are in turn mounted to the chassis 10 at each respective end thereof.

A printhead assembly 11 is mounted to the chassis 10 by means of respective printhead spacers 20 mounted to the chassis 10. The spacer moldings 20 increase the printhead assembly length to 220 mm allowing clearance on either side of 210 mm wide paper.

The printhead construction is shown generally in FIGS. 4 to 8.

Figure 12:
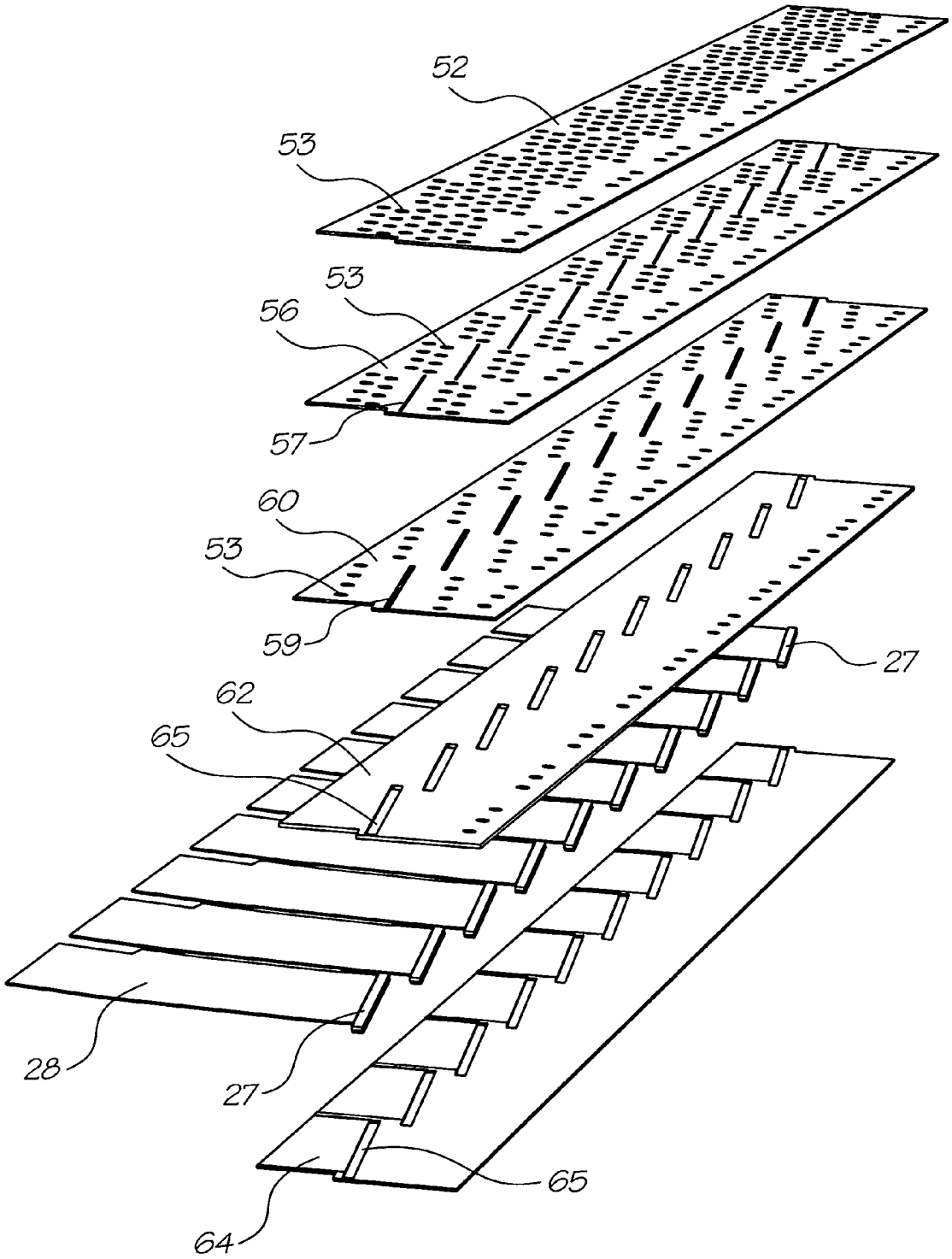
FIG. 12 is an exploded perspective illustration showing the layers forming part of a laminated ink distribution structure according to the present invention.

The printhead assembly 11 includes a printed circuit board (PCB) 21 having mounted thereon various electronic components including a 64 MB DRAM 22, a PEC chip 23, a QA chip connector 24, a microcontroller 25, and a dual motor driver chip 26. The printhead is typically 203 mm long and has ten print chips 27 (FIG. 13), each typically 21 mm long. These print chips 27 are each disposed at a slight angle to the longitudinal axis of the printhead (see FIG. 12), with a slight overlap between each print chip which enables continuous transmission of ink over the entire length of the array. Each print chip 27 is electronically connected to an end of one of the tape automated bond (TAB) films 28, the other end of which is maintained in electrical contact with the undersurface of the printed circuit board 21 by means of a TAB film backing pad 29.

The preferred print chip construction is as described in U.S. Pat. No. 6,044,646 by the present applicant. Each such print chip 27 is approximately 21 mm long, less than 1 mm wide and about 0.3 mm high, and has on its lower surface thousands of MEMS inkjet nozzles 30, shown schematically in FIGS. 9A and 9B, arranged generally in six lines—one for each ink type to be applied. Each line of nozzles may follow a staggered pattern to allow closer dot spacing. Six corresponding lines of ink passages 31 extend through from the rear of the print chip to transport ink to the rear of each nozzle. To protect the delicate nozzles on the surface of the print chip each print chip has a nozzle guard 43, best seen in FIG. 9A, with microapertures 44 aligned with the nozzles 30, so that the ink drops ejected at high speed from the nozzles pass through these microapertures to be deposited on the paper passing over the platen 14.

Ink is delivered to the print chips via a distribution molding 35 and laminated stack 36 arrangement forming part of the printhead 11. Ink from an ink cassette 93 (FIGS. 26 and 27) is relayed via individual ink hoses 94 to individual ink inlet ports 34 integrally molded with a plastics duct cover 39 which forms a lid over the plastics distribution molding 35. The distribution molding 35 includes six individual longitudinal ink ducts 40 and an air duct 41 which extend throughout the length of the array. Ink is transferred from the inlet ports 34 to respective ink ducts 40 via individual cross-flow ink channels 42, as best seen with reference to FIG. 7. It should be noted in this regard that although there are six ducts depicted, a different number of ducts might be provided. Six ducts are suitable for a printer capable of printing four color process (CMYK) as well as infra-red ink and fixative.

Air is delivered to the air duct 41 via an air inlet port 61, to supply air to each print chip 27, as described later with reference to FIGS. 6 to 8, 20 and 21.

Situated within a longitudinally extending stack recess 45 formed in the underside of distribution molding 35 are a number of laminated layers forming a laminated ink distribution stack 36. The layers of the laminate are typically formed of micro-molded plastics material. The TAB film 28 extends from the undersurface of the printhead PCB 21, around the rear of the distribution molding 35 to be received within a respective TAB film recess 46 (FIG. 21), a number of which are situated along a chip housing layer 47 of the laminated stack 36. The TAB film relays electrical signals from the printed circuit board 19 to individual print chips 27 supported by the laminated structure.

The distribution molding, laminated stack 36 and associated components are best described with reference to FIGS. 7 to 19.

Figure 10:
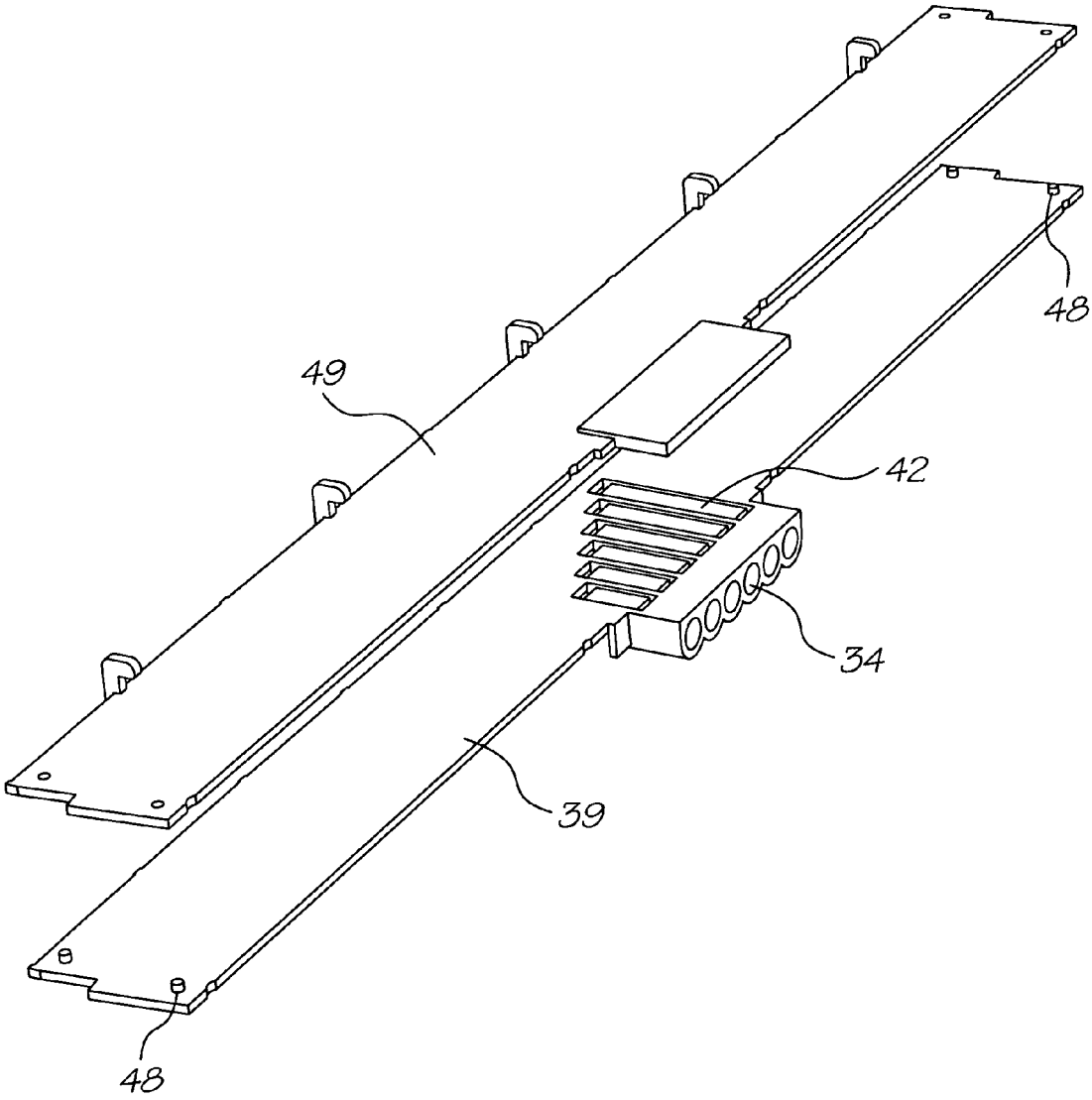
FIG. 10 is an exploded perspective illustration of a printhead cover assembly.
Figure 11:
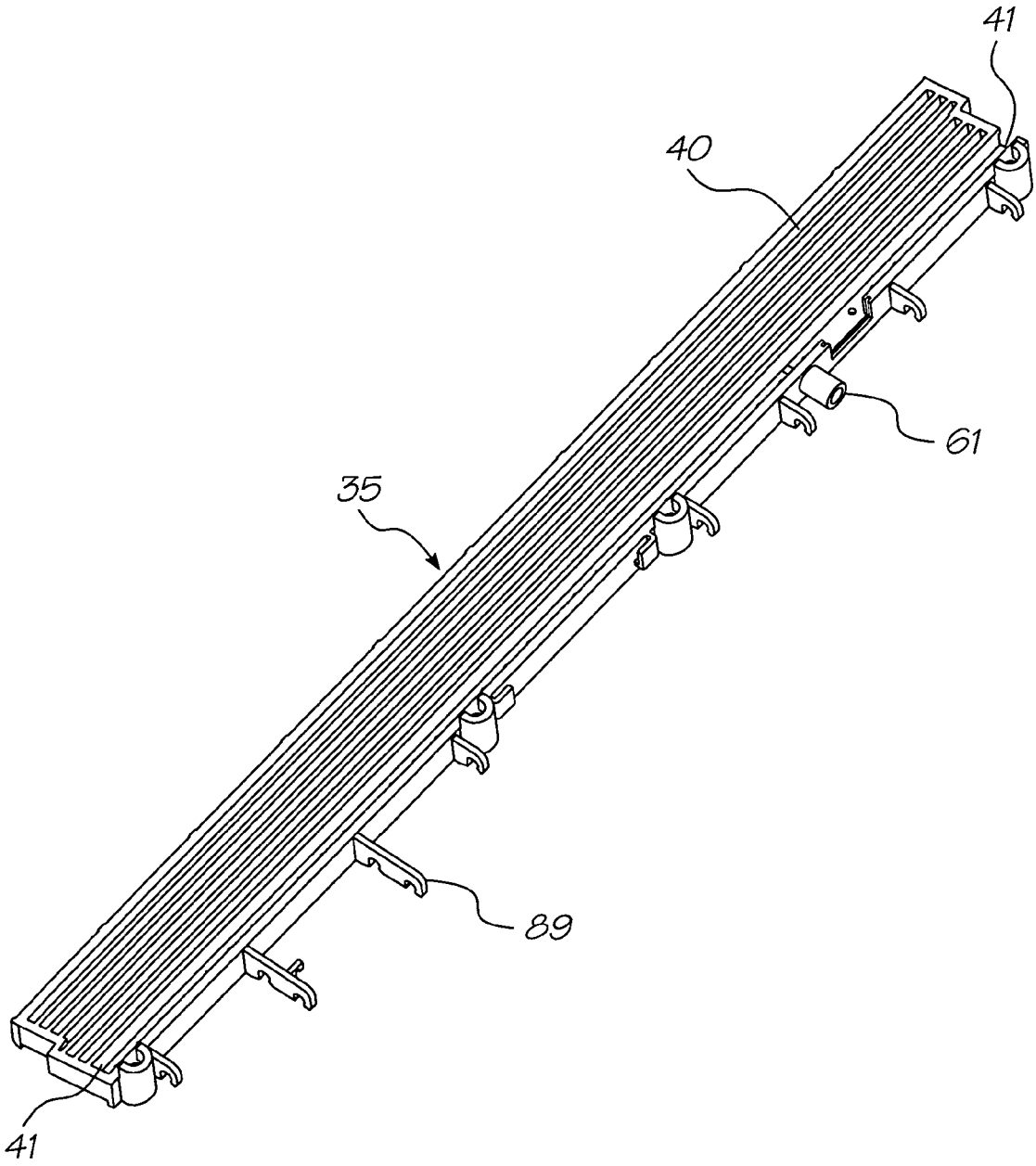
FIG. 11 is a schematic perspective illustration of an ink distribution molding.

FIG. 10 depicts the distribution molding cover 39 formed as a plastics molding and including a number of positioning spigots 48 which serve to locate the upper printhead cover 49 thereon.

Figure 7:
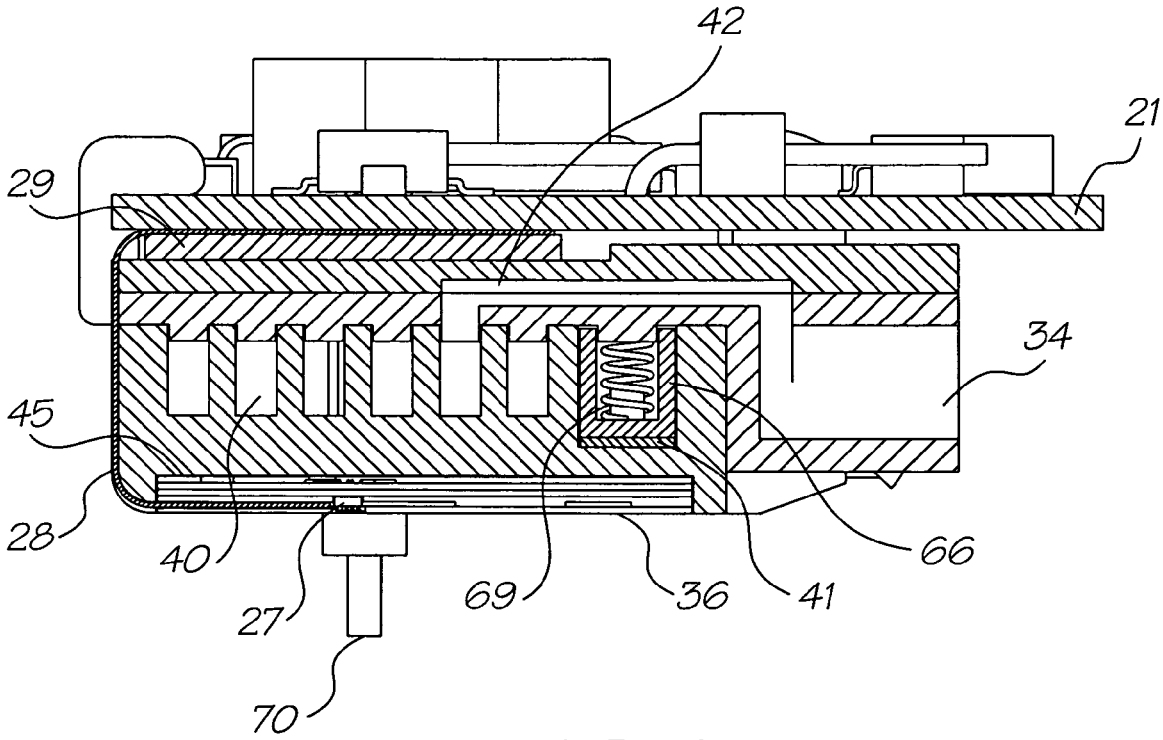
FIG. 7 is a cross-sectional end elevational view of the printhead assembly of FIGS. 4 to 6 with the section taken through the centre of the printhead.

As shown in FIG. 7, an ink transfer port 50 connects one of the ink ducts 40 (the fourth duct from the left) down to one of six lower ink ducts or transitional ducts 51 in the underside of the distribution molding. All of the ink ducts 40 have corresponding transfer ports 50 communicating with respective ones of the transitional ducts 51. The transitional ducts 51 are parallel with each other but angled acutely with respect to the ink ducts 40 so as to line up with the rows of ink holes of the first layer 52 of the laminated stack 36 to be described below.

The first layer 52 incorporates twenty four individual ink holes 53 for each of ten print chips 27. That is, where ten such print chips are provided, the first layer 52 includes two hundred and forty ink holes 53. The first layer 52 also includes a row of air holes 54 alongside one longitudinal edge thereof.

The individual groups of twenty four ink holes 53 are formed generally in a rectangular array with aligned rows of ink holes. Each row of four ink holes is aligned with a transitional duct 51 and is parallel to a respective print chip.

The undersurface of the first layer 52 includes underside recesses 55. Each recess 55 communicates with one of the ink holes of the two centre-most rows of four holes 53 (considered in the direction transversely across the layer 52). That is, holes 53*a* (FIG. 13) deliver ink to the right hand recess 55*a* shown in FIG. 14, whereas the holes 53*b* deliver ink to the left most underside recesses 55*b* shown in FIG. 14.

The second layer 56 includes a pair of slots 57, each receiving ink from one of the underside recesses 55 of the first layer.

The second layer 56 also includes ink holes 53 which are aligned with the outer two sets of ink holes 53 of the first layer 52. That is, ink passing through the outer sixteen ink holes 53 of the first layer 52 for each print chip pass directly through corresponding holes 53 passing through the second layer 56.

The underside of the second layer 56 has formed therein a number of transversely extending channels 58 to relay ink passing through ink holes 53*c* and 53*d* toward the centre. These channels extend to align with a pair of slots 59 formed through a third layer 60 of the laminate. It should be noted in this regard that the third layer 60 of the laminate includes four slots 59 corresponding with each print chip, with two inner slots being aligned with the pair of slots formed in the second layer 56 and outer slots between which the inner slots reside.

The third layer 60 also includes an array of air holes 54 aligned with the corresponding air hole arrays 54 provided in the first and second layers 52 and 56.

Figure 9A:
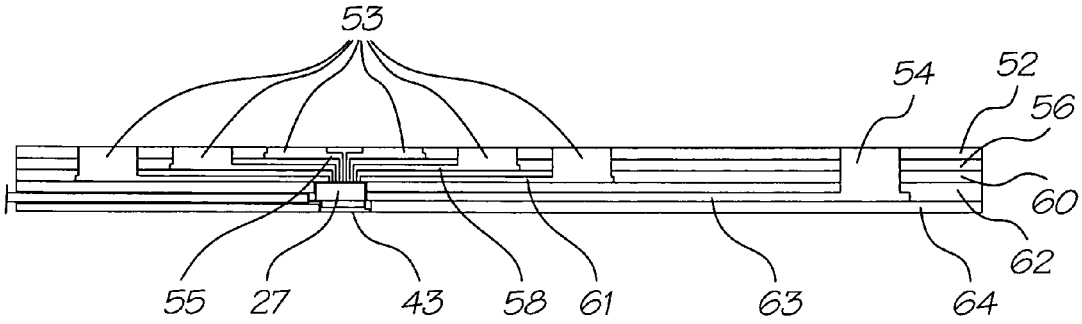
FIG. 9A is a schematic end elevational view of mounting of the print chip and nozzle guard in the laminated stack structure of the printhead
Figure 9B:
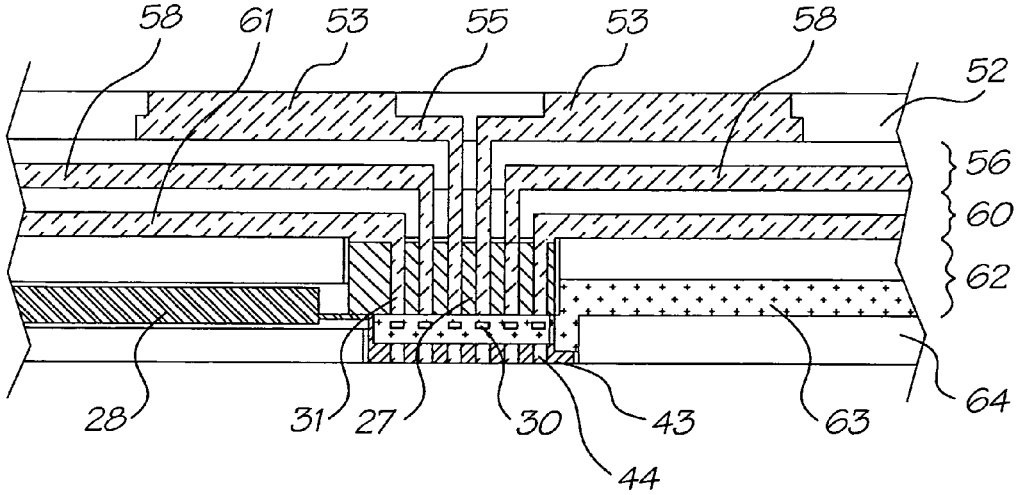
FIG. 9B is an enlarged end elevational cross section of FIG. 9A

The third layer 60 has only eight remaining ink holes 53 corresponding with each print chip. These outermost holes 53 are aligned with the outermost holes 53 provided in the first and second laminate layers. As shown in FIGS. 9A and 9B, the third layer 60 includes in its underside surface a transversely extending channel 61 corresponding to each hole 53. These channels 61 deliver ink from the corresponding hole 53 to a position just outside the alignment of slots 59 therethrough.

As best seen in FIGS. 9A and 9B, the top three layers of the laminated stack 36 thus serve to direct the ink (shown by broken hatched lines in FIG. 9B) from the more widely spaced ink ducts 40 of the distribution molding to slots aligned with the ink passages 31 through the upper surface of each print chip 27.

Figure 13:
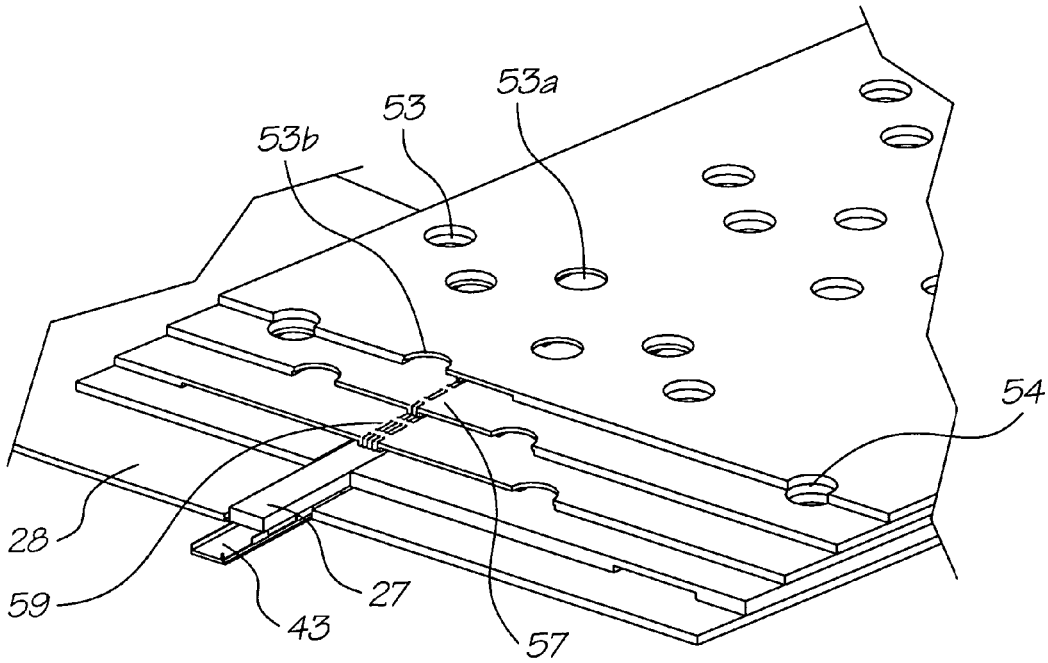
FIG. 13 is a stepped sectional view from above of the structure depicted in FIGS. 9A and 9B.
Figure 14:
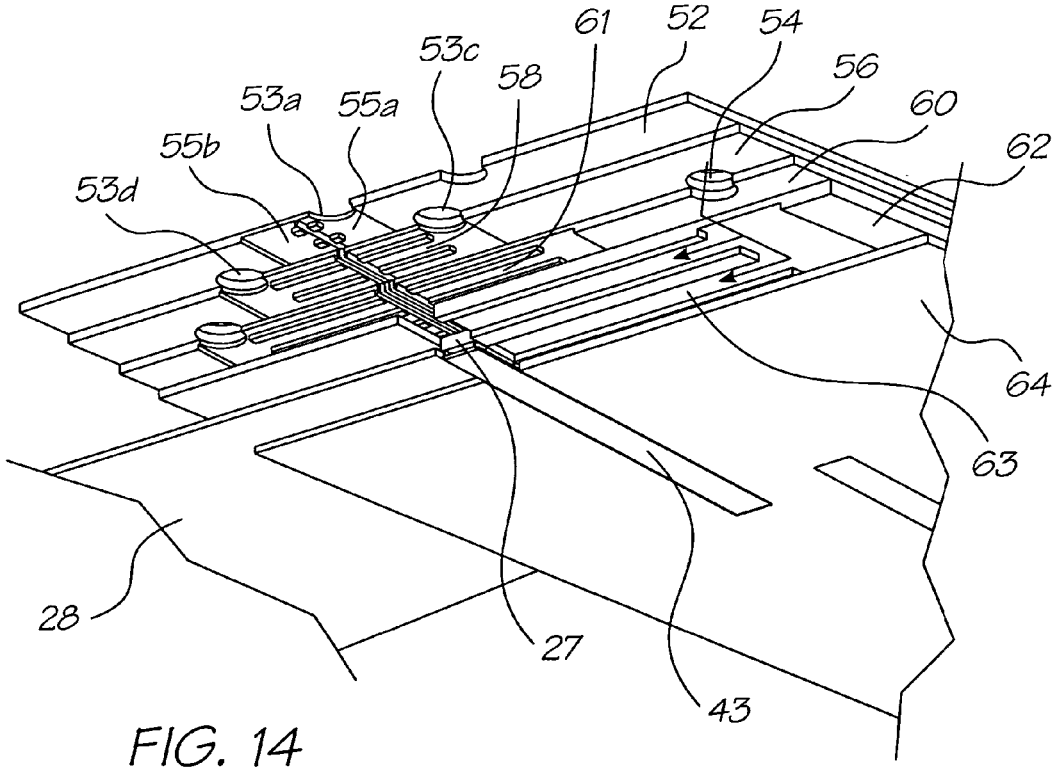
FIG. 14 is a stepped sectional view from below of the structure depicted in FIG. 13.
Figure 15:
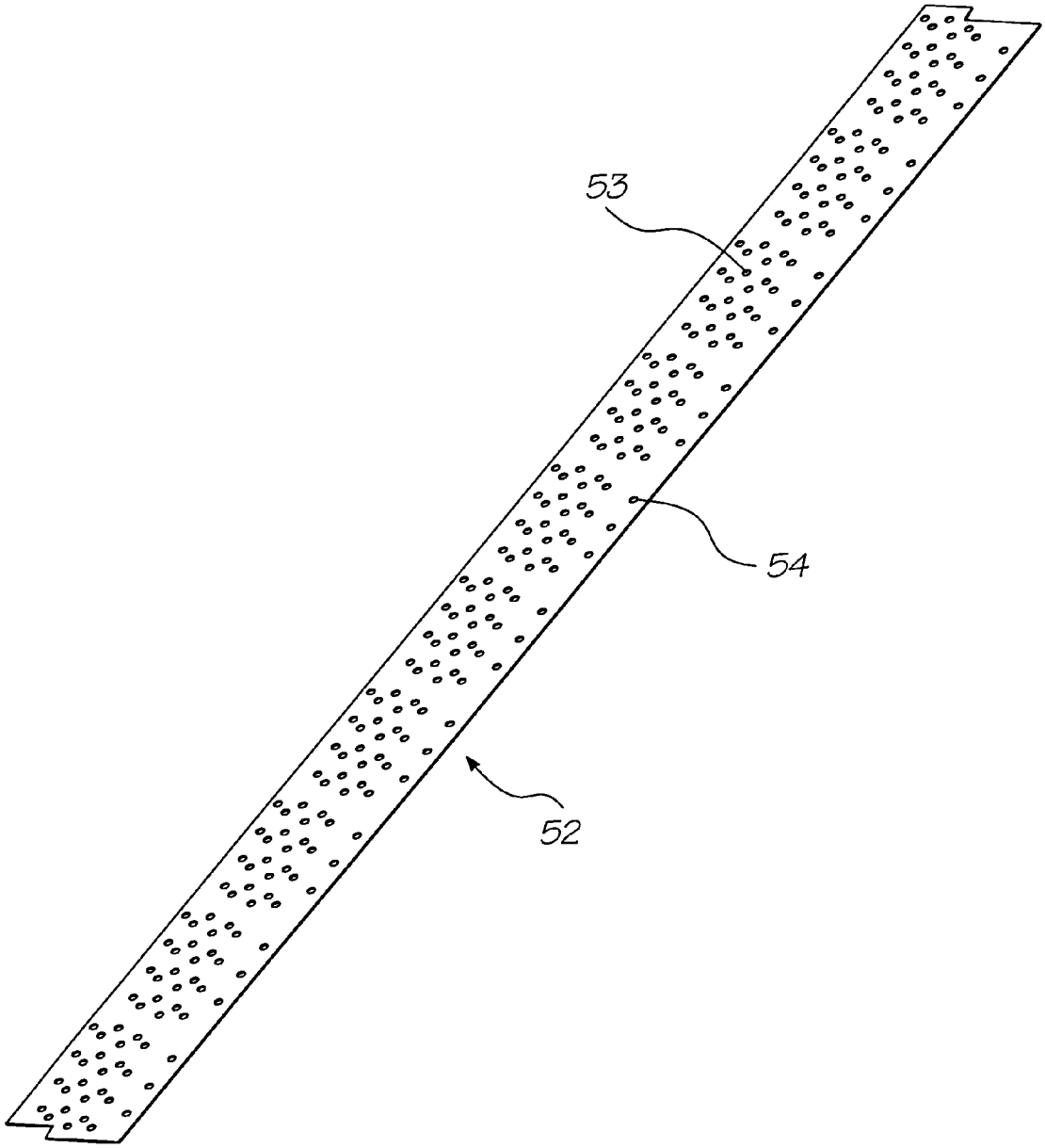
FIG. 15 is a schematic perspective illustration of a first laminate layer.
Figure 16:
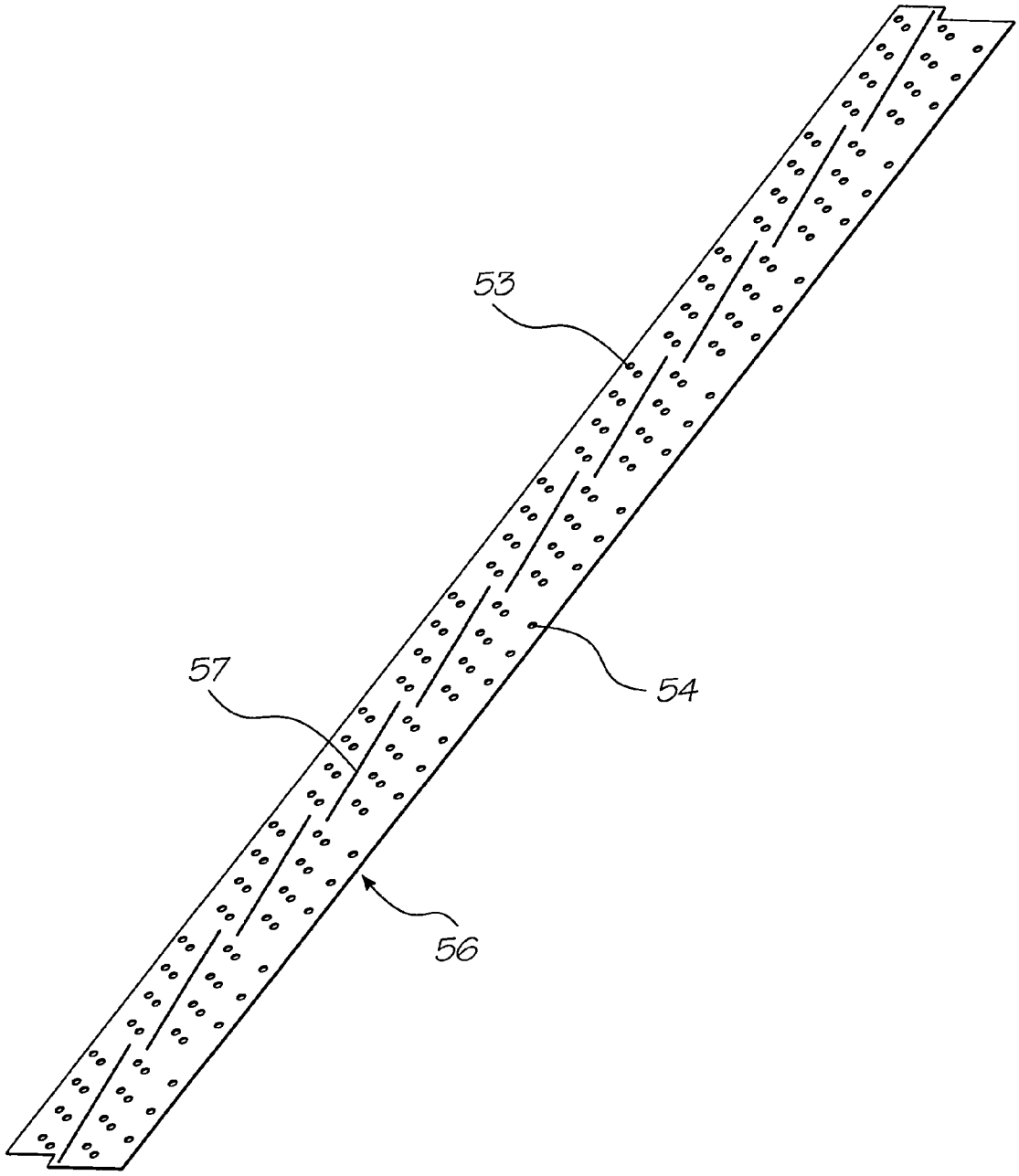
FIG. 16 is a schematic perspective illustration of a second laminate layer.
Figure 17:
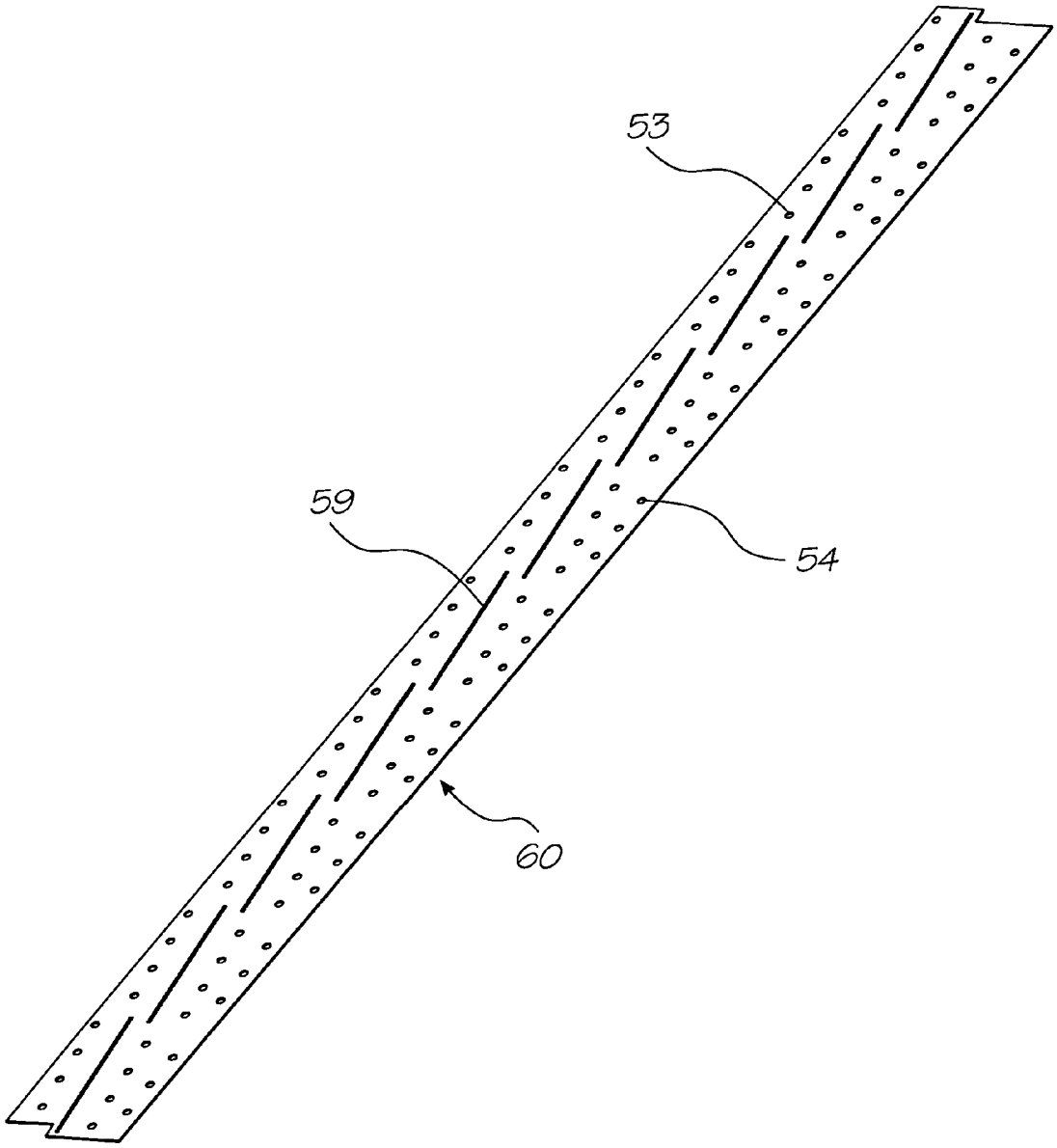
FIG. 17 is a schematic perspective illustration of a third laminate layer.
Figure 18:
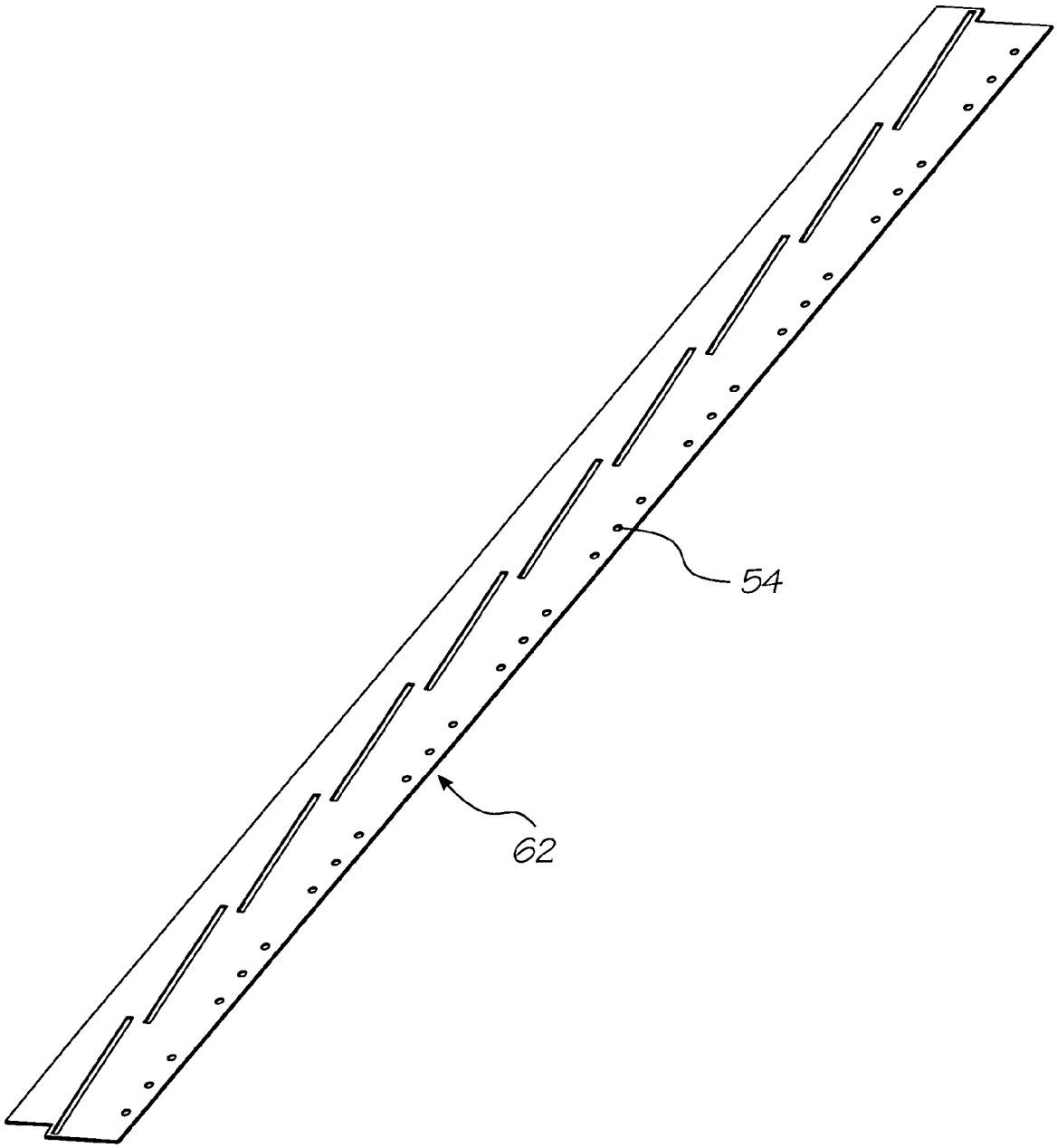
FIG. 18 is a schematic perspective illustration of a fourth laminate layer.
Figure 19:
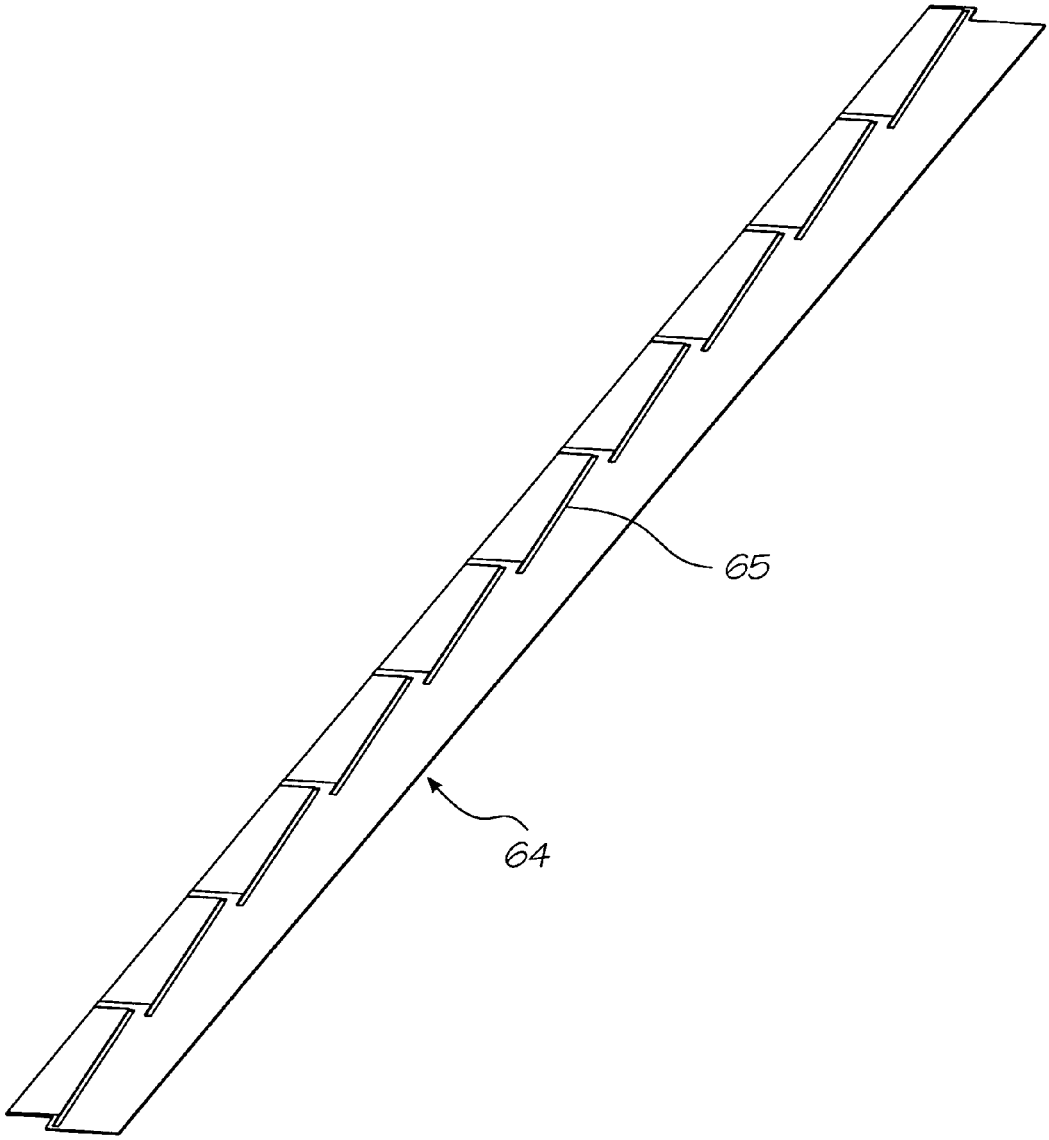
FIG. 19 is a schematic perspective illustration of a fifth laminate layer.
Figure 20:
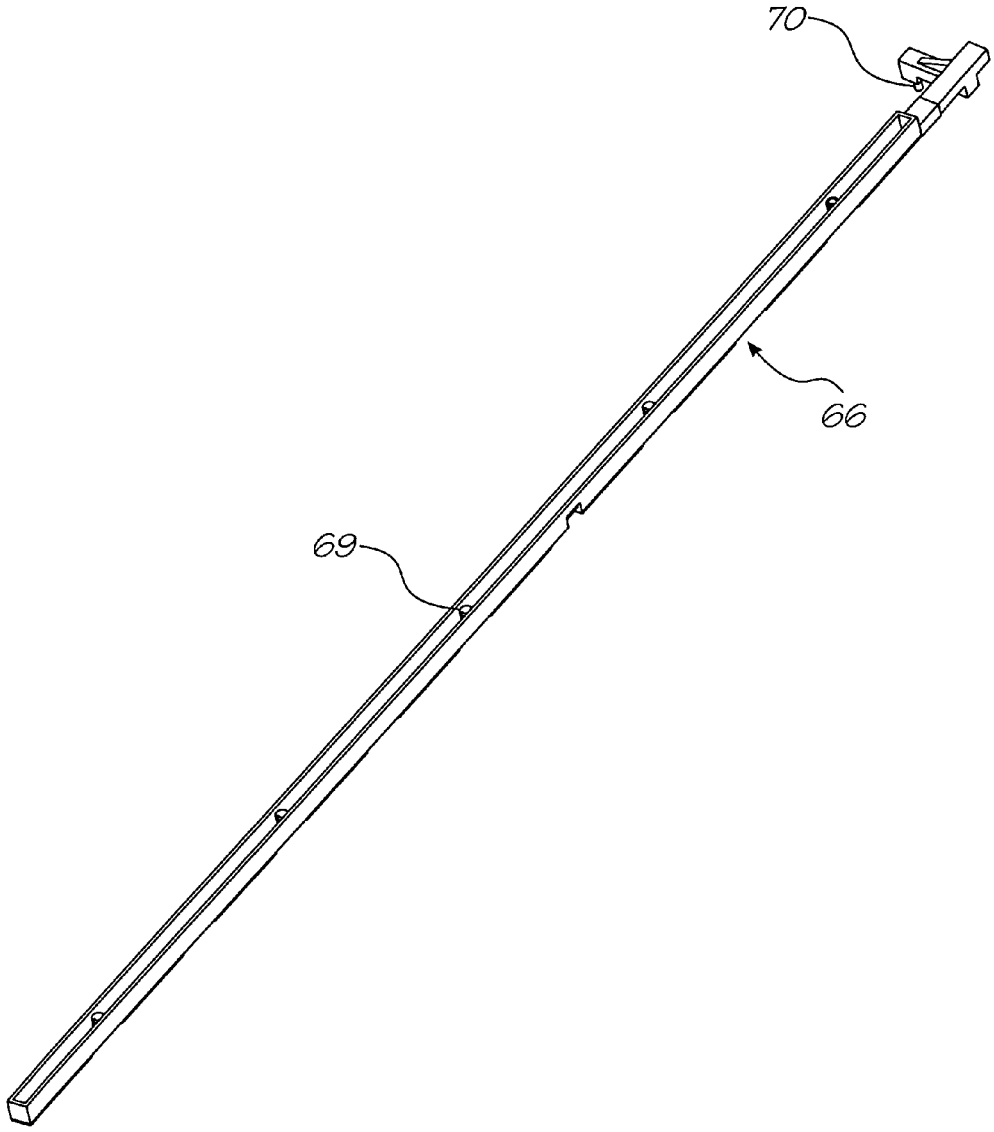
FIG. 20 is a perspective view of the air valve molding
Figure 22:
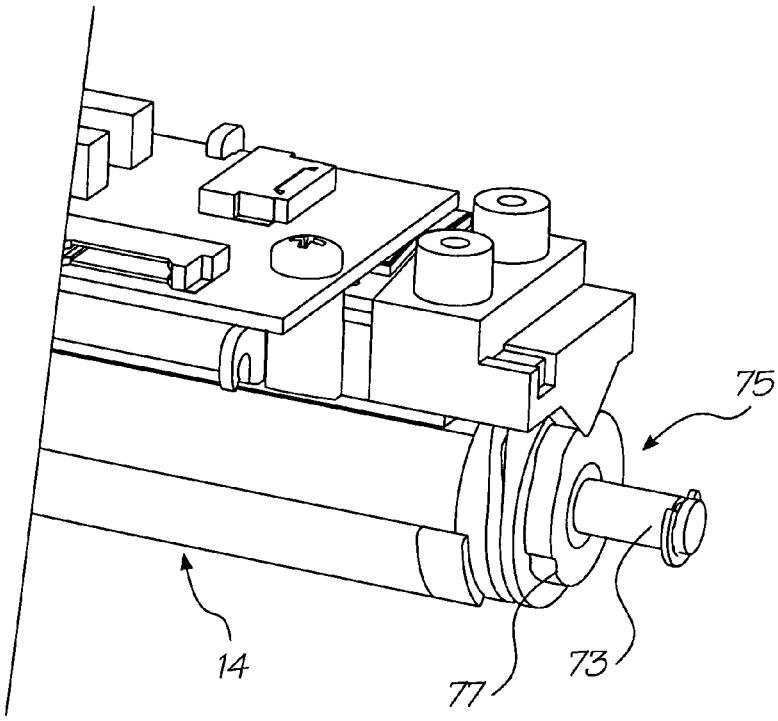
FIG. 22 is a rear perspective view of the left hand end of the platen
Figure 21:
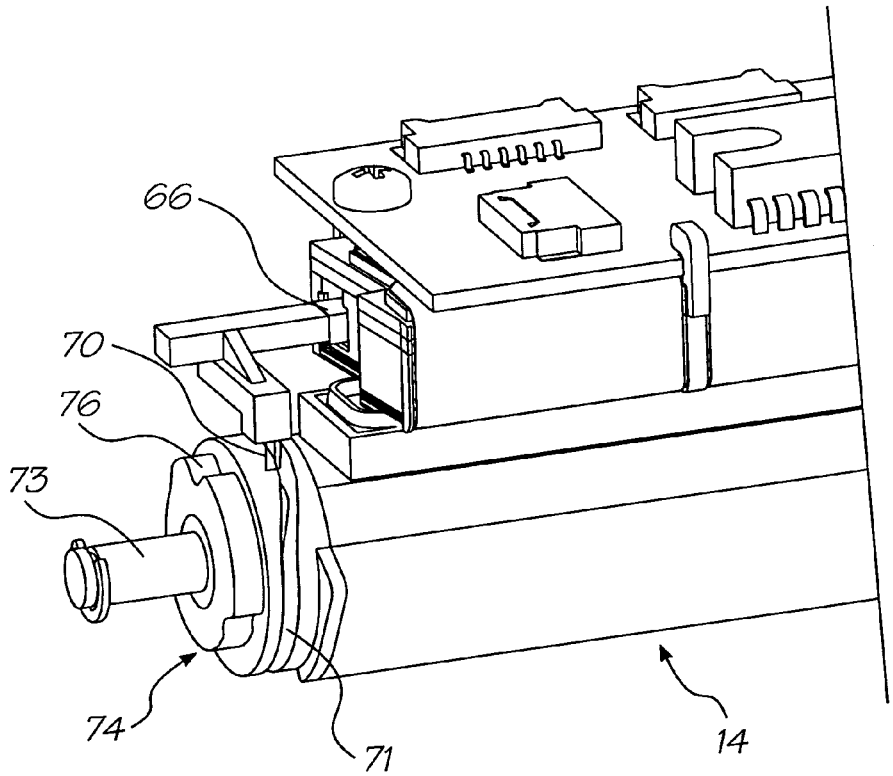
FIG. 21 is a rear perspective view of the right hand end of the platen

As shown in FIG. 13, which is a view from above the laminated stack, the slots 57 and 59 can in fact be comprised of discrete co-linear spaced slot segments.

The fourth layer 62 of the laminated stack 36 includes an array of ten chip-slots 65 each receiving the upper portion of a respective print chip 27.

The fifth and final layer 64 also includes an array of chip-slots 65 which receive the chip and nozzle guard assembly 43.

The TAB film 28 is sandwiched between the fourth and fifth layers 62 and 64, one or both of which can be provided with recesses to accommodate the thickness of the TAB film.

The laminated stack is formed as a precision micro-molding, injection molded in an Acetal type material. It accommodates the array of print chips 27 with the TAB film already attached and mates with the cover molding 39 described earlier.

Rib details in the underside of the micro-molding provides support for the TAB film when they are bonded together. The TAB film forms the underside wall of the printhead module, as there is sufficient structural integrity between the pitch of the ribs to support a flexible film. The edges of the TAB film seal on the underside wall of the cover molding 39. The chip is bonded onto one hundred micron wide ribs that run the length of the micro-molding, providing a final ink feed to the print nozzles.

The design of the micro-molding allow for a physical overlap of the print chips when they are butted in a line. Because the printhead chips now form a continuous strip with a generous tolerance, they can be adjusted digitally to produce a near perfect print pattern rather than relying on very close toleranced moldings and exotic materials to perform the same function. The pitch of the modules is typically 20.33 mm.

The individual layers of the laminated stack as well as the cover molding 39 and distribution molding can be glued or otherwise bonded together to provide a sealed unit. The ink paths can be sealed by a bonded transparent plastic film serving to indicate when inks are in the ink paths, so they can be fully capped off when the upper part of the adhesive film is folded over. Ink charging is then complete.

The four upper layers 52, 56, 60, 62 of the laminated stack 36 have aligned air holes 54 which communicate with air passages 63 formed as channels formed in the bottom surface of the fourth layer 62, as shown in FIGS. 9*b* and 13. These passages provide pressurised air to the space between the print chip surface and the nozzle guard 43 whilst the printer is in operation. Air from this pressurised zone passes through the micro-apertures 44 in the nozzle guard, thus preventing the build-up of any dust or unwanted contaminants at those apertures. This supply of pressurised air can be turned off to prevent ink drying on the nozzle surfaces during periods of non-use of the printer, control of this air supply being by means of the air valve assembly shown in FIGS. 6 to 8, 20 and 21.

Figure 6:
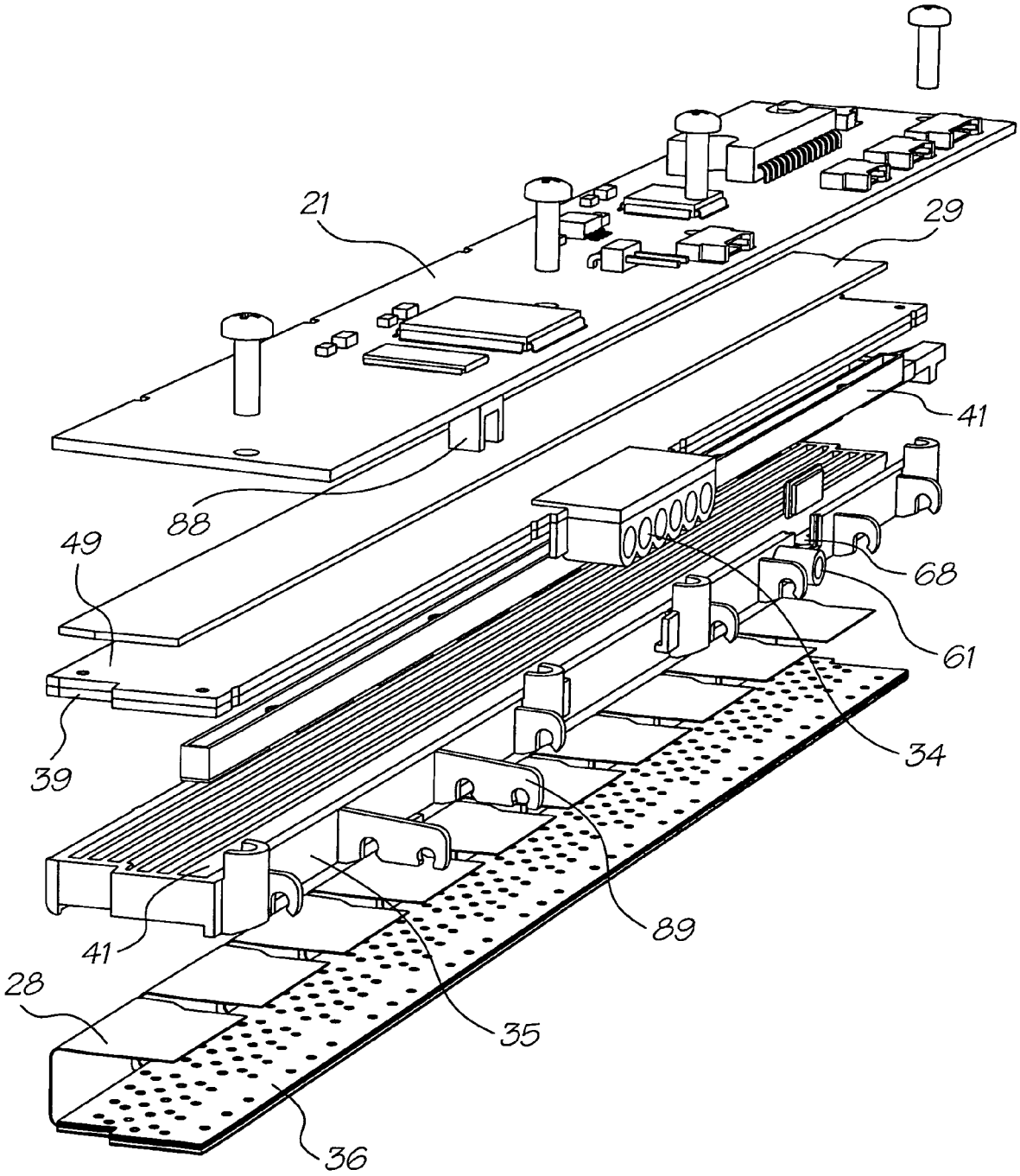
FIG. 6 is an exploded perspective illustration of the printhead assembly.
Figure 8:
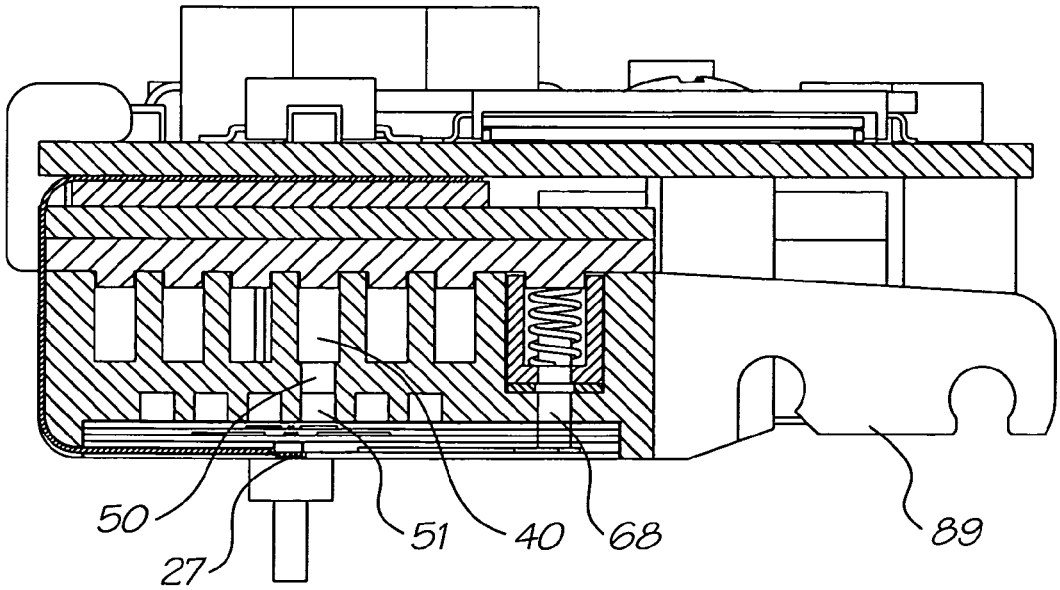
FIG. 8 is a schematic cross-sectional end elevational view of the printhead assembly of FIGS. 4 to 6 taken near the left end of FIG. 4.

With reference to FIGS. 6 to 8, within the air duct 41 of the printhead there is located an air valve molding 66 formed as a channel with a series of apertures 67 in its base. The spacing of these apertures corresponds to air passages 68 formed in the base of the air duct 41 (see FIG. 6), the air valve molding being movable longitudinally within the air duct so that the apertures 67 can be brought into alignment with passages 68 to allow supply the pressurized air through the laminated stack to the cavity between the print chip and the nozzle guard, or moved out of alignment to close off the air supply. Compression springs 69 maintain a sealing inter-engagement of the bottom of the air valve molding 66 with the base of the air duct 41 to prevent leakage when the valve is closed.

The air valve molding 66 has a cam follower 70 extending from one end thereof, which engages an air valve cam surface 71 on an end cap 74 of the platen 14 so as to selectively move the air valve molding longitudinally within the air duct 41 according to the rotational positional of the multi-function platen 14, which may be rotated between printing, capping and blotting positions depending on the operational status of the printer, as will be described below in more detail with reference to FIGS. 21 to 24. When the platen 14 is in its rotational position for printing, the cam holds the air valve in its open position to supply air to the print chip surface, whereas when the platen is rotated to the non-printing position in which it caps off the micro-apertures of the nozzle guard, the cam moves the air valve molding to the valve closed position.

With reference to FIGS. 21 to 24, the platen member 14 extends parallel to the printhead, supported by a rotary shaft 73 mounted in bearing molding 18 and rotatable by means of gear 79 (see FIG. 3). The shaft is provided with a right hand end cap 74 and left hand end cap 75 at respective ends, having cams 76, 77.

The platen member 14 has a platen surface 78, a capping portion 80 and an exposed blotting portion 81 extending along its length, each separated by 120°. During printing, the platen member is rotated so that the platen surface 78 is positioned opposite the printhead so that the platen surface acts as a support for that portion of the paper being printed at the time. When the printer is not in use, the platen member is rotated so that the capping portion 80 contacts the bottom of the printhead, sealing in a locus surrounding the microapertures 44. This, in combination with the closure of the air valve by means of the air valve arrangement when the platen 14 is in its capping position, maintains a closed atmosphere at the print nozzle surface. This serves to reduce evaporation of the ink solvent (usually water) and thus reduce drying of ink on the print nozzles while the printer is not in use.

The third function of the rotary platen member is as an ink blotter to receive ink from priming of the print nozzles at printer start up or maintenance operations of the printer. During this printer mode, the platen member 14 is rotated so that the exposed blotting portion 81 is located in the ink ejection path opposite the nozzle guard 43. The exposed blotting portion 81 is an exposed part of a body of blotting material 82 inside the platen member 14, so that the ink received on the exposed portion 81 is drawn into the body of the platen member.

Figure 23:
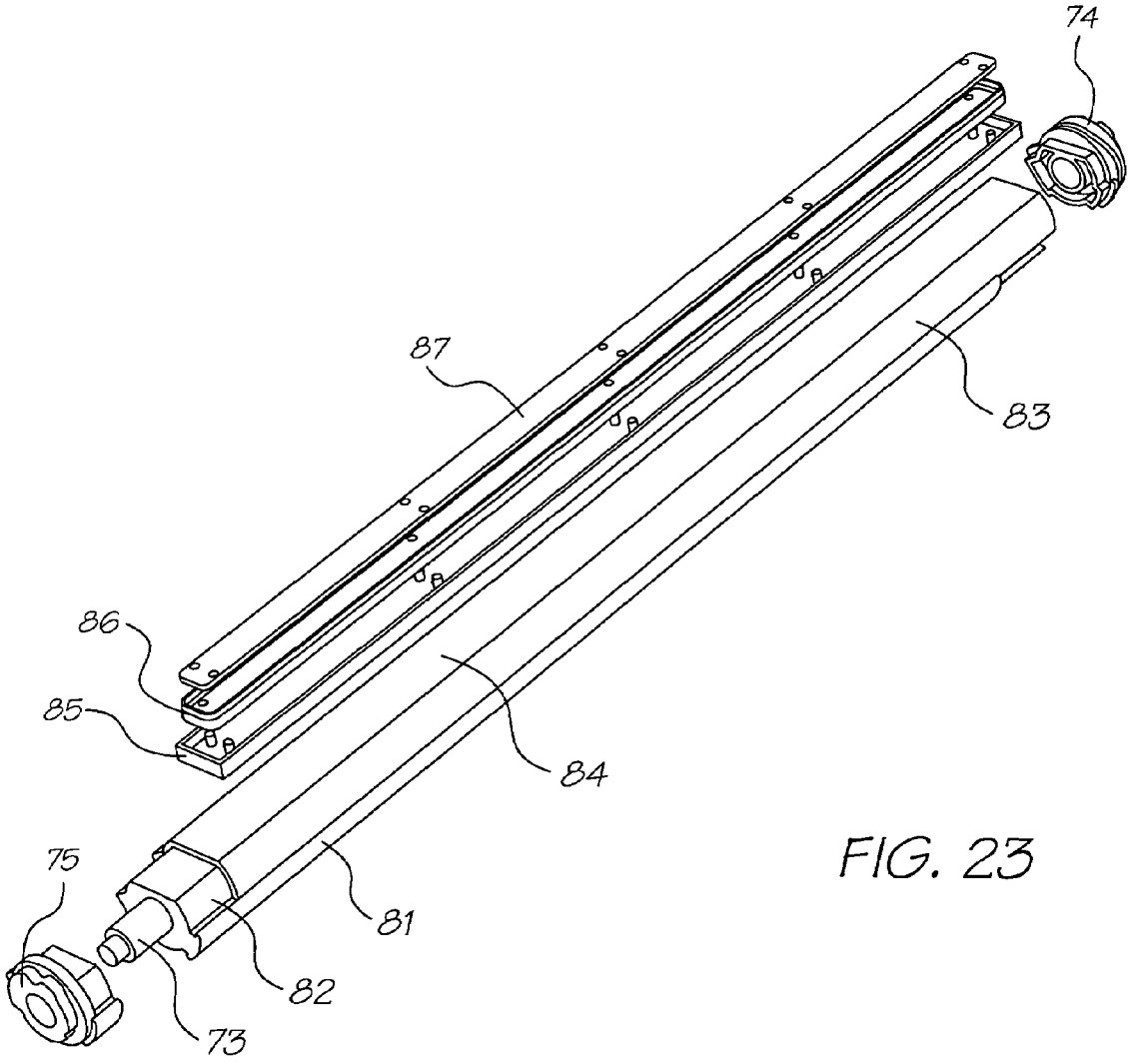
FIG. 23 is an exploded view of the platen
Figure 24:
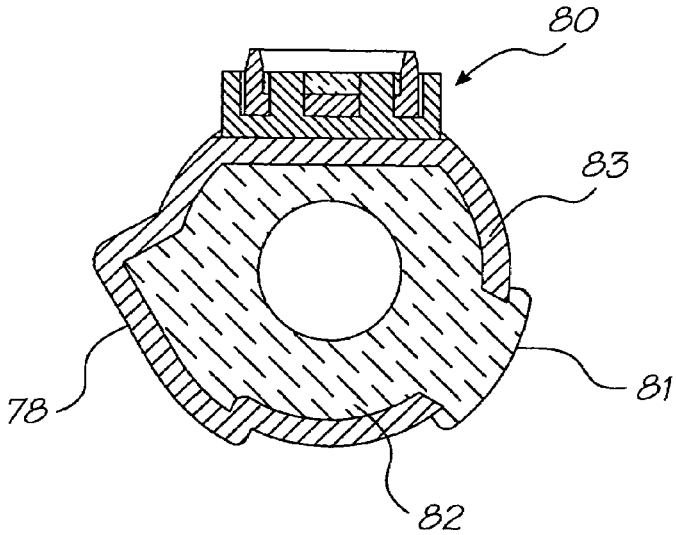
FIG. 24 is a transverse cross-sectional view of the platen

Further details of the platen member construction may be seen from FIGS. 23 and 24. The platen member consists generally of an extruded or molded hollow platen body 83 which forms the platen surface 78 and receives the shaped body of blotting material 82 of which a part projects through a longitudinal slot in the platen body to form the exposed blotting surface 81. A flat portion 84 of the platen body 83 serves as a base for attachment of the capping member 80, which consists of a capper housing 85, a capper seal member 86 and a foam member 87 for contacting the nozzle guard 43.

With reference again to FIG. 1, each bearing molding 18 rides on a pair of vertical rails 101. That is, the capping assembly is mounted to four vertical rails 101 enabling the assembly to move vertically. A spring 102 under either end of the capping assembly biases the assembly into a raised position, maintaining cams 76,77 in contact with the spacer projections 100.

The printhead 11 is capped when not is use by the full-width capping member 80 using the elastomeric (or similar) seal 86. In order to rotate the platen assembly 14, the main roller drive motor is reversed. This brings a reversing gear into contact with the gear 79 on the end of the platen assembly and rotates it into one of its three functional positions, each separated by 120°.

The cams 76, 77 on the platen end caps 74, 75 co-operate with projections 100 on the respective printhead spacers 20 to control the spacing between the platen member and the printhead depending on the rotary position of the platen member. In this manner, the platen is moved away from the printhead during the transition between platen positions to provide sufficient clearance from the printhead and moved back to the appropriate distances for its respective paper support, capping and blotting functions.

Figure 25:
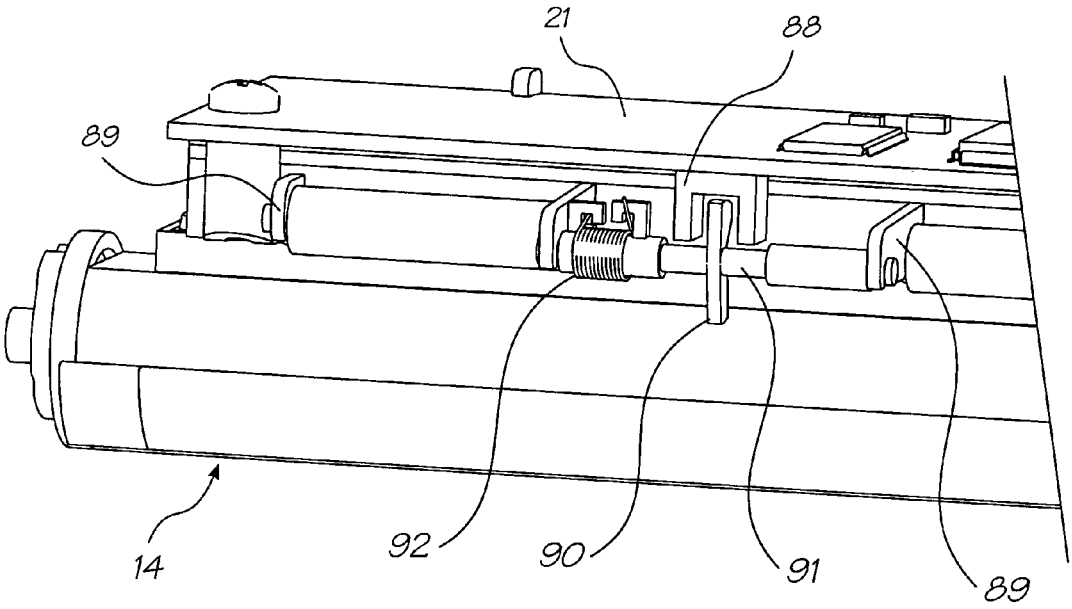
FIG. 25 is a front perspective view of the optical paper sensor arrangement

In addition, the cam arrangement for the rotary platen provides a mechanism for fine adjustment of the distance between the platen surface and the printer nozzles by slight rotation of the platen 14. This allows compensation of the nozzle-platen distance in response to the thickness of the paper or other material being printed, as detected by the optical paper thickness sensor arrangement illustrated in FIG. 25.

The optical paper sensor includes an optical sensor 88 mounted on the lower surface of the PCB 21 and a sensor flag arrangement mounted on the arms 89 protruding from the distribution molding. The flag arrangement comprises a sensor flag member 90 mounted on a shaft 91 which is biased by torsion spring 92. As paper enters the feed rollers, the lowermost portion of the flag member contacts the paper and rotates against the bias of the spring 92 by an amount dependent on the paper thickness. The optical sensor detects this movement of the flag member and the PCB responds to the detected paper thickness by causing compensatory rotation of the platen 14 to optimize the distance between the paper surface and the nozzles.

Figure 26:
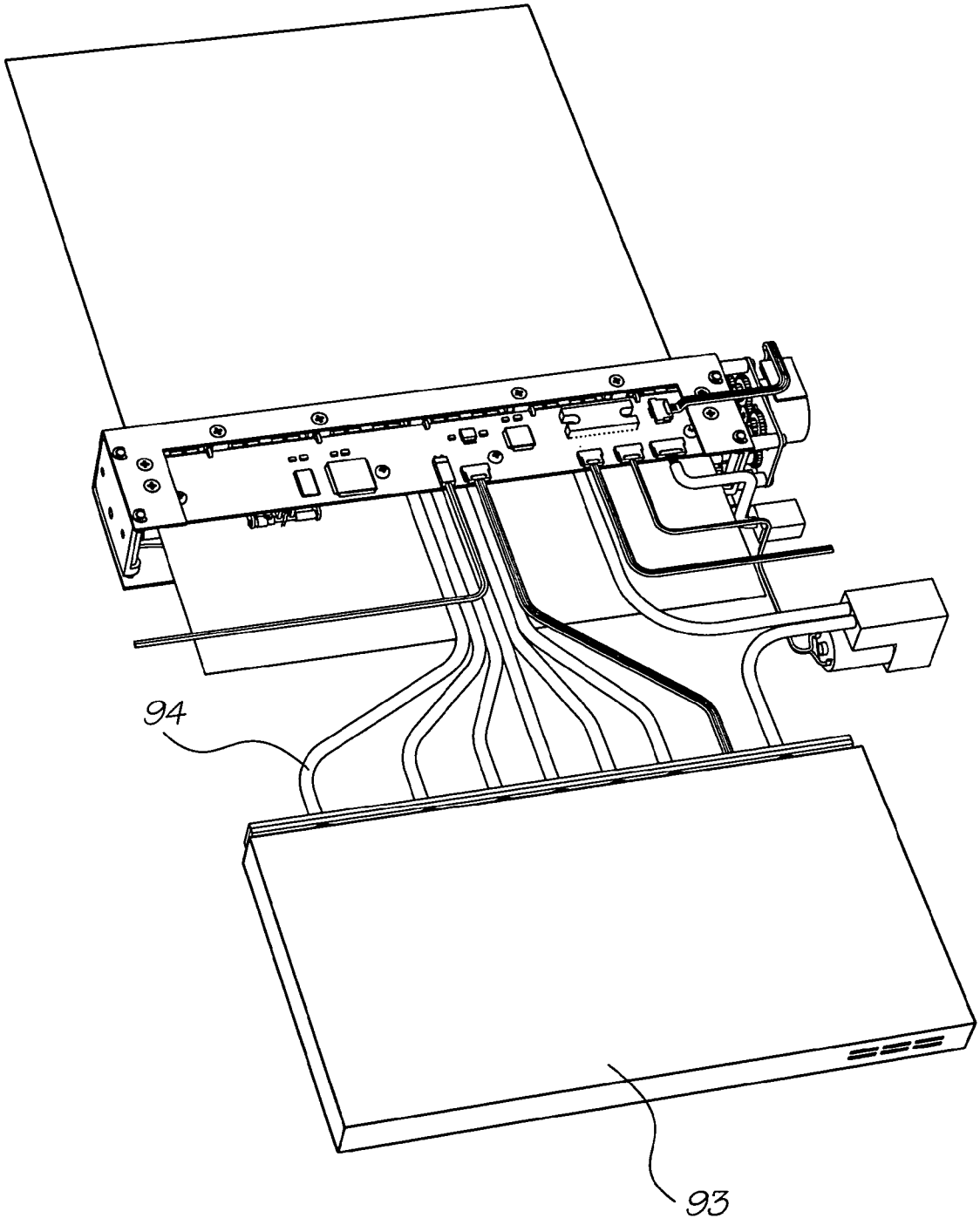
FIG. 26 is a schematic perspective illustration of a printhead assembly and ink lines attached to an ink reservoir cassette.
Figure 27:
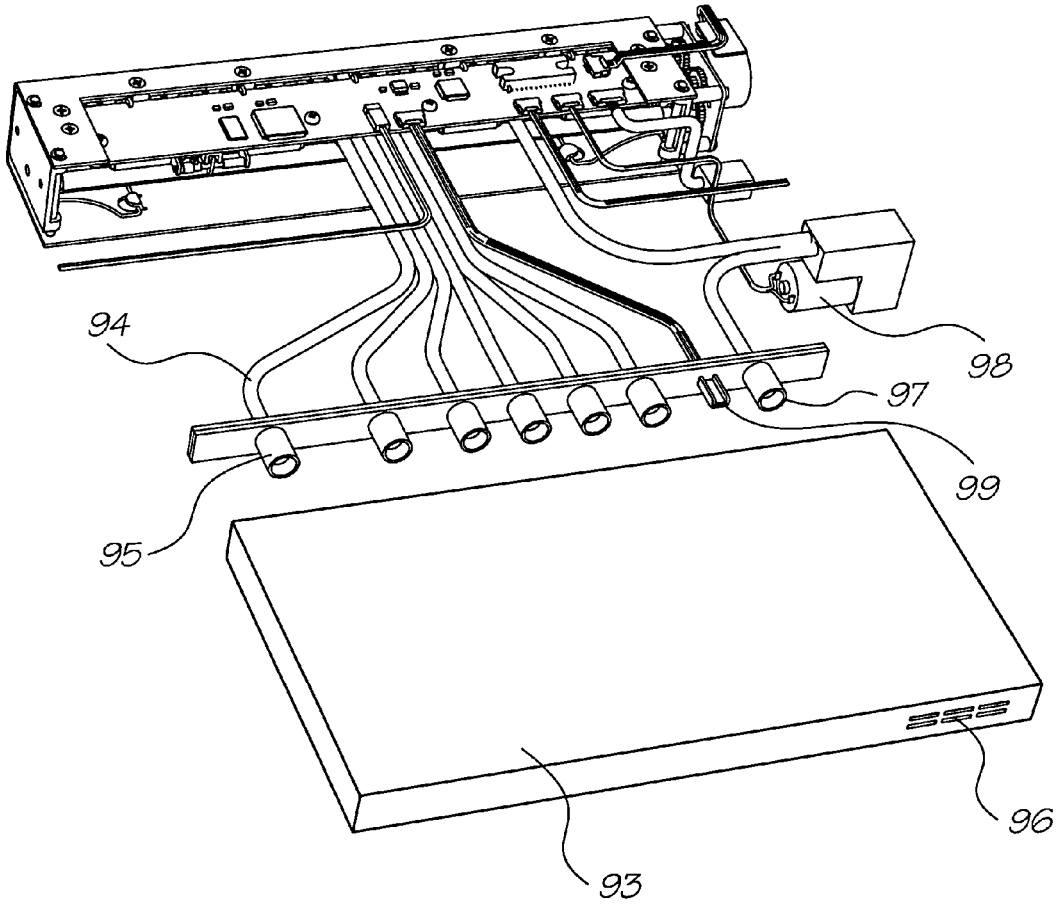
FIG. 27 is a partly exploded view of FIG. 26.

FIGS. 26 and 27 show attachment of the illustrated printhead assembly to a replaceable ink cassette 93. Six different inks are supplied to the printhead through hoses 94 leading from an array of female ink valves 95 located inside the printer body. The replaceable cassette 93 containing a six compartment ink bladder and corresponding male valve array is inserted into the printer and mated to the valves 95. The cassette also contains an air inlet 96 and air filter (not shown), and mates to the air intake connector 97 situated beside the ink valves, leading to the air pump 98 supplying filtered air to the printhead. A QA chip is included in the cassette. The QA chip meets with a contact 99 located between the ink valves 95 and air intake connector 96 in the printer as the cassette is inserted to provide communication to the QA chip connector 24 on the PCB.

I claim:

1. A print engine assembly comprising;

an elongate chassis for mounting to a printer body, the chassis defining a channel and a slot;

a printhead assembly fast with respect to the chassis and configured to print upon print media fed through the chassis;

a pair of bearing moldings located within the channel and mounted on respective, opposite ends of the chassis; and a print media feed mechanism mounted between the bearing moldings and arranged to feed the print media through the chassis in register with the printhead assembly and out through the slot, the feed mechanism comprising a stepper motor mounted to one of the bearing mouldings and a plurality of rollers driven by the stepper motor.

2. A print engine assembly as claimed in claim 1, wherein the chassis is fabricated from any one of the group of: pressed steel, aluminum, plastics and other like rigid material.

3. A print engine assembly as claimed in claim 1, further comprising a pair of spacers, each spacer interconnecting a respective end of the printhead assembly with the chassis.

4. A print engine assembly as claimed in claim 1, wherein the printhead assembly comprises an elongate printhead, the printhead comprising a plurality of elongate integrated circuits each disposed at an angle to a longitudinal axis of the printhead with an overlap between each adjacent pair of integrated circuits to provide for continuous transmission of ink along the integrated circuits.

5. A print engine assembly as claimed in claim 4, wherein the printhead assembly further comprises:

a printed circuit board (PCB) having mounted thereon electrical control components; and one or more tape automated bond (TAB) films interconnected between the PCB and the integrated circuits so that the integrated circuits are electrically coupled to the electrical control components.

6. A print engine assembly as claimed in claim 4, wherein the printhead assembly further comprises an ink distribution molding configured to distribute ink to the integrated circuits.

7. A print engine assembly as claimed in claim 6, further comprising an ink cassette defining a plurality of ink supplies, and a plurality of hoses arranged to each interconnect a respective ink supply with the ink distribution molding.

* * * * *